US007445405B2

(12) United States Patent
Yurkevich

(10) Patent No.: US 7,445,405 B2
(45) Date of Patent: Nov. 4, 2008

(54) REINFORCED-CONCRETE COLUMN IN THE SOIL PIT

(75) Inventor: Pavel Borisovich Yurkevich, Moscow (RU)

(73) Assignee: Yurkevich Engineering Bureau Ltd., Moscow (RU)

( * ) Notice: Subject to any disclaimer, the term of this patent is extended or adjusted under 35 U.S.C. 154(b) by 932 days.

(21) Appl. No.: 10/854,565

(22) Filed: May 25, 2004

(65) Prior Publication Data

US 2004/0237435 A1 Dec. 2, 2004

(30) Foreign Application Priority Data

Jun. 2, 2003 (RU) ..... 2003116153
Nov. 12, 2003 (RU) ..... 2003132805

(51) Int. Cl.
*E02D 5/30* (2006.01)

(52) U.S. Cl. ..... 405/239; 405/257

(58) Field of Classification Search ..... 405/239, 405/256, 257, 233, 232, 231
See application file for complete search history.

(56) References Cited

U.S. PATENT DOCUMENTS 5,359,829 A * 11/1994 Voita ..... 405/239
5,542,785 A * 8/1996 Cloud ..... 405/239
5,599,599 A * 2/1997 Mirmiran et al. ..... 428/36.3
6,123,485 A * 9/2000 Mirmiran et al. ..... 405/256
6,219,991 B1 * 4/2001 Salek-Nejad ..... 52/741.3
6,293,071 B1 * 9/2001 Konstantinidis ..... 52/659

FOREIGN PATENT DOCUMENTS

RU 2094575 10/1997
RU 99118847 7/2001
RU 2197578 1/2003

OTHER PUBLICATIONS

Concise Polytechnic Dictionary; State Publishing House of Technical and Theoretical Literature, 1956, p. 830, abstract "Pile".

(Continued)

*Primary Examiner*—Frederick L Lagman
(74) *Attorney, Agent, or Firm*—Frishauf, Holtz, Goodman & Chick, P.C.

(57) ABSTRACT

A reinforced-concrete column contains reinforcing cage and inserts made monolithic with concrete mix and comprises the upper bearing and lower foundation parts. The method of construction of the column includes operations of manufacture of the column reinforcing cage with inserts, placement of concrete in the non-removable casing in the project position in single- or multi-slit pit with the column making monolithic. The column reinforcing cage is loaded vertically into the pit, centered vertically, and the upper part is fixed from horizontal displacements, the lower foundation part of the column and the inner part of the non-removable casing with the closed-type casing in the upper bearing part of the column are made monolithic with concrete from down to top. After making monolithic, the soil base is widened and cemented via the process pipeline placed inside the reinforcing cage; the space between the non-removable casing and the pit walls in the upper bearing part is filled with granular material.

5 Claims, 25 Drawing Sheets

OTHER PUBLICATIONS

Concise Polytechnic Dictionary; State Publishing House of Technical and Theoretical Literature, 1956, p. 429, abstract "Column".

I.N. Bronshtein et al; K.A. Handbook on Mathematics, Publishing House of Physical and Mathematician Literature, 1962, pp. 167, 219 and 428.

N.S. Metelyuk et al; Piles and Pile Foundation, Kiev, "Budivelnik", 1977, p. 49-51.

P.B. Yurkevich, "Drill Columns—New Reality" World Underground Space, 2001, No. 4, p. 12-21.

* cited by examiner

1

1-1

9-9

REINFORCED-CONCRETE COLUMN IN THE SOIL PIT

This application claims the benefit of Russian application No 2003116153 filed in Russia Jun. 2, 2003 and of Russian application No 2003132805 filed in Russia Nov. 12, 2003, the entire contents of which is incorporated therein by reference.

FIELD OF THE APPLICATION

The invention relates to the art of construction, especially in straitened conditions, in particular, to the elements and methods of monolithic construction of elements of buildings and structures, and namely, bearing reinforced-concrete elements.

BACKGROUND OF THE INVENTION

There is a device for transfer of pressure to underlying solid layers of soil formed by filling the drilled boreholes with concrete. /Concise polytechnic dictionary. -M: State publishing house of technical and theoretical literature, 1956., p. 830, abstract "Pile"/.

There is a device for transfer of pressure to underlying solid layers of soil formed by filling the soil pits-slits or trench catches with concrete.

There is a device in the form of vertical support for carrying elements of the structure slabs. /Concise polytechnic dictionary. -M: State publishing house of technical and theoretical literature, 1956, p. 429, abstract "Column"/.

There are columns with junction elements in the floor levels made with formation of the shell, as well as the columns not only of the round cross-section but also square one. /Patent of the RU No. 2197578, Int.Cl. (7) E04B Jan. 18, 2000/.

Equivalent diameter—maximum distance from geometric center of column cross-section to the curve of the second order (circle, ellipse, etc) circumscribed round the points of column cross-section contour may serve a distinctive feature for the columns of arbitrary cross-section/Bronshtein I. N., Semendyaev K. A. Handbook on mathematics. -M.: Publishing House of physical and mathematician literature, 1962, pp. 167, 219, 428/

There is reinforced-concrete support containing the cage made monolithic with concrete mix, comprising reinforcement and bond joints/Patent of the RU No. 2094575, Int.Cl. (6) E04C 5/01, E04B Jan. 16, 1991/.

The closest by substance and achieved technical result pertaining to construction is the reinforced-concrete column, comprising reinforcing cage made monolithic with concrete mix and inserts, the column consists of the upper bearing and lower foundation parts/Metelyuk N. S. and other authors. Piles and pile foundations, Kiev, "Budivelnik", 1977, p. 49-51/.

There is a method for construction of the columns, comprising installation of reinforcement of column cages, installation of reinforcing cages, installation of column casing (formwork) and concrete of the fram elements/RU Application No. 99118847/03, 2001, Int.Cl. E04B1/16/.

There is also a method for construction of bore reinforce-concrete column, comprising operations of the column cage manufacturing with inserts, concreting in the non-removable casing in the project position in the soil pit with the column making monolithic, taken by the applicant as the closest analogue (prior art method)/Yurkevich P. B. "Drill columns—new reality"// "World underground space", 2001, No. 4, p. 12-21, M.: ISSN 0869-799X, TIMP/.

Disadvantage of the known devices and methods of their installation—impossibility of combining of works of zero cycle with works on construction of elements of building or structure above zero mark.

SUMMARY OF THE INVENTION

It is an object of the present invention to provide a reinforced concrete column in the soil pit.

Another object of the present invention is to provide new method of construction of said reinforced concrete column in the soil pit The technical aim of the invention and technical result—raising accuracy over vertical when installing bearing foundation elements and elements carrying the load of construction of the building or structure and providing possibility of constructing the building, structure simultaneously upwards and downwards below the zero mark.

According to the present invention, there is provided a reinforced-concrete column, comprises reinforcing cage made monolithic with the concrete mix and inserts, consisting of the upper bearing and lower foundation parts, in contrast to the known column, is made in the single- or multi-slit soil pit. In this case, the upper part of reinforcing cage is arranged in non-removable casing with the closed-type contour, projection of geometric center of cross-section of which is combined with projection of geometric center of cross-section of the lower part of reinforcing cage, and the sizes of the branches of the lower part of the reinforcing cage along axis Y are taken with the proviso that:

$A_{Ki}<A_{Bi}$ by value $\Omega_y=2(\epsilon_y+\alpha_y+\beta_y)$, where Y—axis passing through geometric center of cross-section of the lower part of the cage; $A_{Ki}$—basic sizes of branches of the lower part of the column cage along axis Y; $A_{Bi}$—basic sizes of pit slits corresponding to them along axis Y; K—index of the size related to the cage; B—index of the size related to slit-pit; i—size index; $\epsilon_y$—component of eccentricity along axis Y of projection of geometric center of one-piece column reinforcing cage relative to projection of its center of masses in the plane of its top; $\alpha_y$—maximum deviation of the pit from vertical along axis Y; $\beta_y$—deviation of geometric center of cross-section of the pit in the plane along axis Y in the plane of the column top, the sizes of branches of the lower part of reinforcing cage along axis X are taken with the proviso that:

$B_{Ki}<B_{Bi}$ by value $\Omega_x=2(\epsilon_x+\alpha_x+\beta_x)$, where X—axis passing through geometric center of cross-section of the lower part of the cage, perpendicular to axis Y; $B_{Ki}$—basic sizes of branches of the lower part of the column cage along axis X; $B_{Bi}$—basic sizes of the pit slits along axis X; $\epsilon_x$—component of eccentricity along axis X of projection of geometric center of the column one-piece reinforcing cage relative to projection of its center of masses in the plane of its top; $\alpha_x$—maximum deviation of the pit from vertical along axis X; $\beta_x$—deviation of geometric center of cross-section of the pit in the plane along axis X in the plane of the column top, and the inserts are arranged in the upper bearing part of the column at the levels of the marks of the foundation slab and the marks of the floor slabs and made in the form of closed-type contours with stiffening ribs.

The column is made in non-removable casing in the borehole with reinforcing cage equivalent maximum outer diameter $D_k<D_c$ by value $\Omega_r=2(\epsilon_r+\alpha_r+\beta_r)$, where $D_c=A_B=B_B$—diameter of the borehole; $\epsilon_r=\sqrt{(\epsilon_x^2+\epsilon_y^2)}$—total eccentricity of projection of geometric axis relative to projection of axis of center of masses of the column in the plane of the column top;

$\alpha_r=\sqrt{(\alpha_x^2+\alpha_y^2)}$—total deviation of axis of the borehole from vertical; $\beta_r=\sqrt{(\beta_x^2+\beta_y^2)}$—total deviation of axis of the borehole in the plane; non-removable casing is made from the pipe of round, rectangular or other arbitrary cross-section with closed-type contour, symmetrical with respect to axes X, Y; the lower part of the column is provided with the bottom hole chamber and fixing rods.

The reinforcing cage part arranged in the lower foundation part of the column is connected "lap joint" with the reinforcing cage part arranged in the upper bearing part with attachment of elements of the reinforcing cage.

In the slit pits the sizes of the reinforcing cage part arranged in the upper bearing part of the column are equal or less than inner sizes of non-removable casing with the closed-type contour, basic sizes along axes X, Y of the branches of the reinforcing cage lower part arranged in the lower foundation part of the column are equal or more than basic outer sizes of the non-removable casing.

In the borehole pits the equivalent outer diameter of the reinforcing cage part arranged in the upper bearing part of the column is equal or less than the inner diameter of the non-removable casing; the equivalent inner diameter of the reinforcing cage part arranged in the lower foundation part of the column is equal or more than the outer diameter of the non-removable casing.

According to the present invention, there is provided a method of construction of the reinforced-concrete column in the soil pit includes operations of manufacture of the column reinforcing cage with inserts, placement of concrete in the non-removable casing in the project position in single- or multi-slit pit with provision of making the column monolithic.

When constructing the column in single- or multi-slit pit, the column is made from upper bearing and lower foundation parts; in this case, the pit in soil is made with sizes along axis Y taken with the proviso that $A_{Bi}>A_{Ki}+2(\epsilon_y+\alpha_y+\beta_y)$ and along axis X with sizes taken with the proviso that $B_{Bi}>B_{Ki}+2(\epsilon_x+\alpha_x+\beta_x)$, where Y—axis passing through geometric center of cross-section of the lower part of the cage; X—axis passing through geometric center of cross-section of the lower part of the cage, perpendicular to axis Y; $A_{Ki}$—basic sizes of branches of the lower part of the column cage along axis Y; $B_{Ki}$—basic sizes of branches of the lower part of the column cage along axis X; $A_{Bi}$—basic sizes of the pit slit along axis Y corresponding to the branches; $B_{Bi}$—basic sizes of the pit slits along axis X; K—index of the size related to the cage; B—index of the size related to slit-pit; i—size index; $\epsilon_y$ and $\epsilon_x$—components of eccentricity along axes Y and X, respectively, of projection of geometric center of one-piece reinforcing cage of the column respective to projection of its center of masses in the plane of its top; $\alpha_y$ and $\alpha_x$—maximum deviations of the pit from vertical along axes Y and X, respectively; $\beta_y$ and $\beta_x$—deviations of geometric center of cross-section of the pit in the plane along axes Y and X, respectively, in the plane of the column top. The column reinforcing cage is installed vertically into the pit with gap from its bottom, vertically centered with compensation for eccentricity, and the upper part is fixed from horizontal displacements, the lower foundation part of the column and the internal part of non-removable casing with the closed-type contour in the upper bearing part of the column are made monolithic from down to top.

Concrete in the non-removable casing in the project position is placed in the borehole with provision of making it monolithic; in this case, the borehole is drilled with diameter $D_c=A_B=B_B\geqq D_k=A_K=B_K+2(\epsilon_r+\alpha_r+\beta_r)$, where $D_k$—maximum equivalent outer diameter of the column reinforcing cage; $\epsilon_r=\sqrt{(\epsilon_x^2+\epsilon_y^2)}$—total eccentricity of projection of geometric axis in regard with projection of the axis of center of masses of the column in the plane of the column top; $\alpha_r=\sqrt{(\alpha_x^2+\alpha_y^2)}$—total deviation of axis of the borehole from vertical; $\beta_r=\sqrt{(\beta_x^2+\beta_y^2)}$—total deviation of axis of the borehole in the plane; the column reinforcing cage is vertically installed into the borehole with the gap from the borehole bottom by value $P\geqq 0{,}1D_c$, the upper part is vertically centered with compensation for eccentricity and fixed from horizontal displacements, is vertically lowered on the base of the borehole with fixation of the lower part with fixing plates, the lower foundation part of the column and internal part of non-removable casing of the upper bearing part of the column are made monolithic with concrete from down to top.

The soil base is widened and cemented after making monolithic via the process pipeline placed inside of the reinforcing cage; the space between non-removable casing and the walls of the pit are filled in the upper bearing part with granular material.

Figure 1:
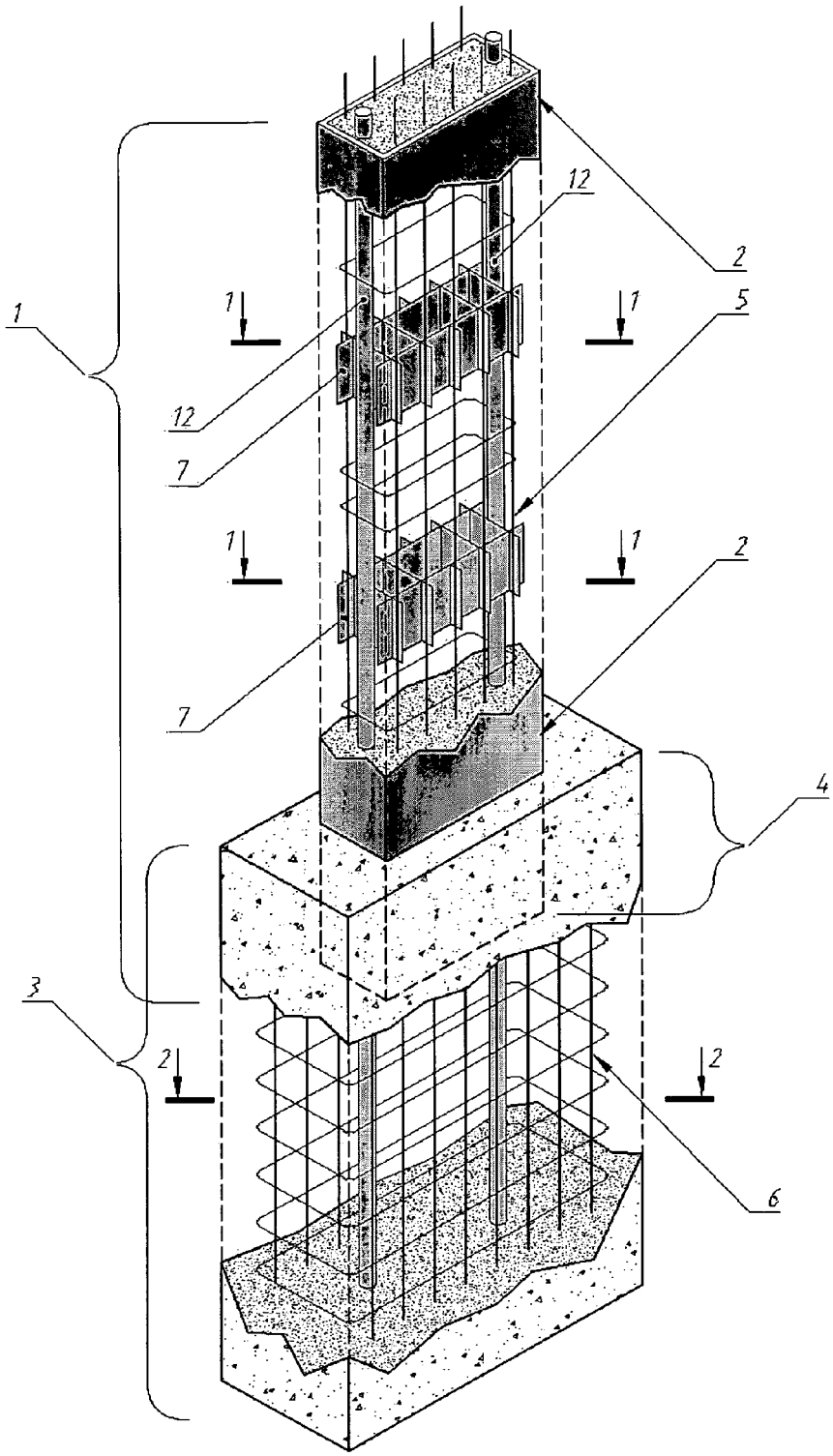
FIG. 1 shows the example of the design of the reinforced-concrete column with arrangement of non-removable casing with the closed-type contour of rectangular cross-section in the upper bearing part of the column for the case of constructing the column in the single-slit pit.
Figure 2:
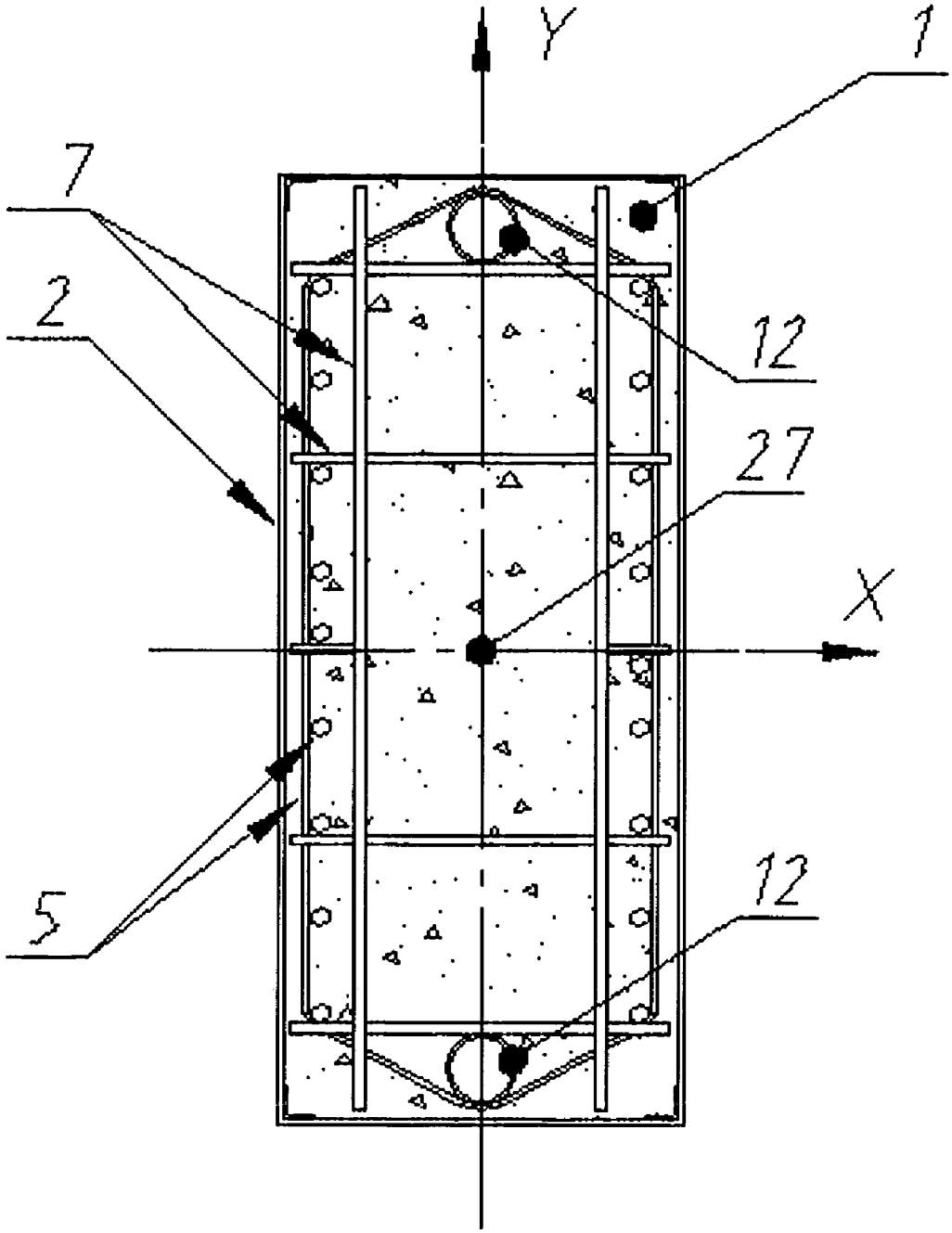
FIG. 2 shows section "1-1" in FIG. 1 at the level of marks of inserts with perpendicular ribs.
Figure 3:
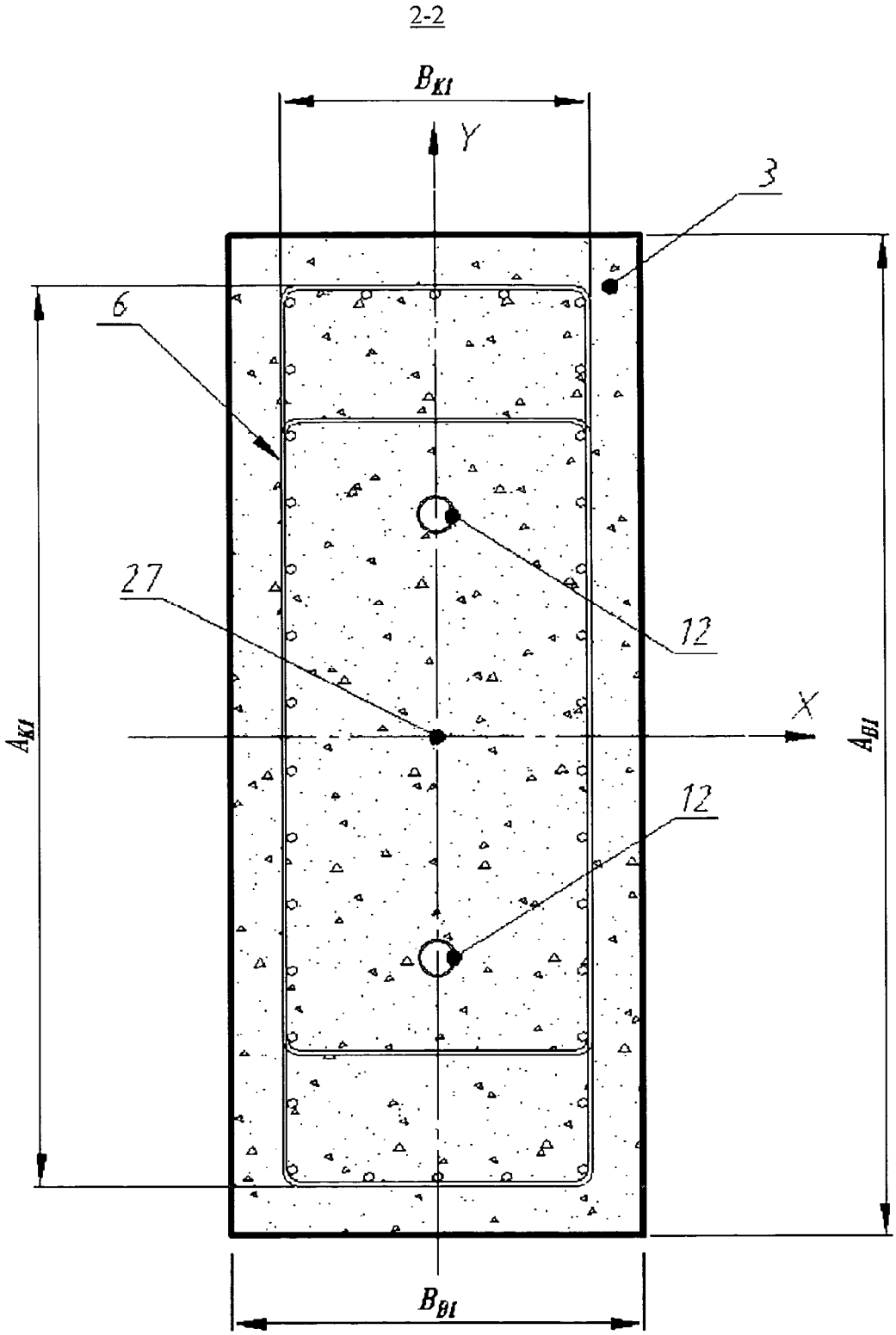
FIG. 3 shows section "2-2" in FIG. 1 in the lower foundation part of the column.
Figure 4:
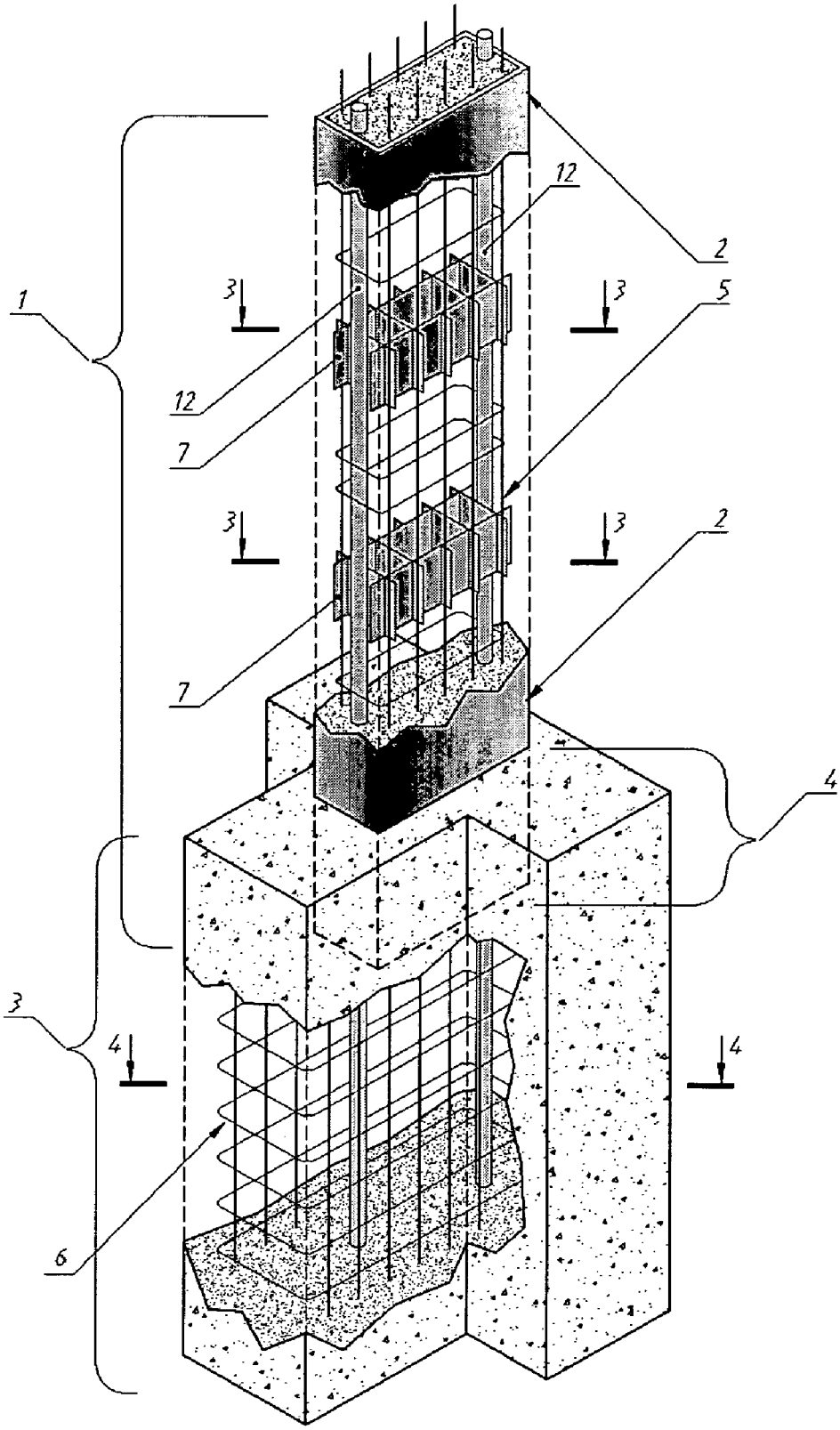
FIG. 4 shows the example of the design of the reinforced-concrete column with arrangement of non-removable casing with the closed-type contour of rectangular cross-section in the upper bearing part of the column for the case of constructing the column in the double-slit pit of T-section.
Figure 5:
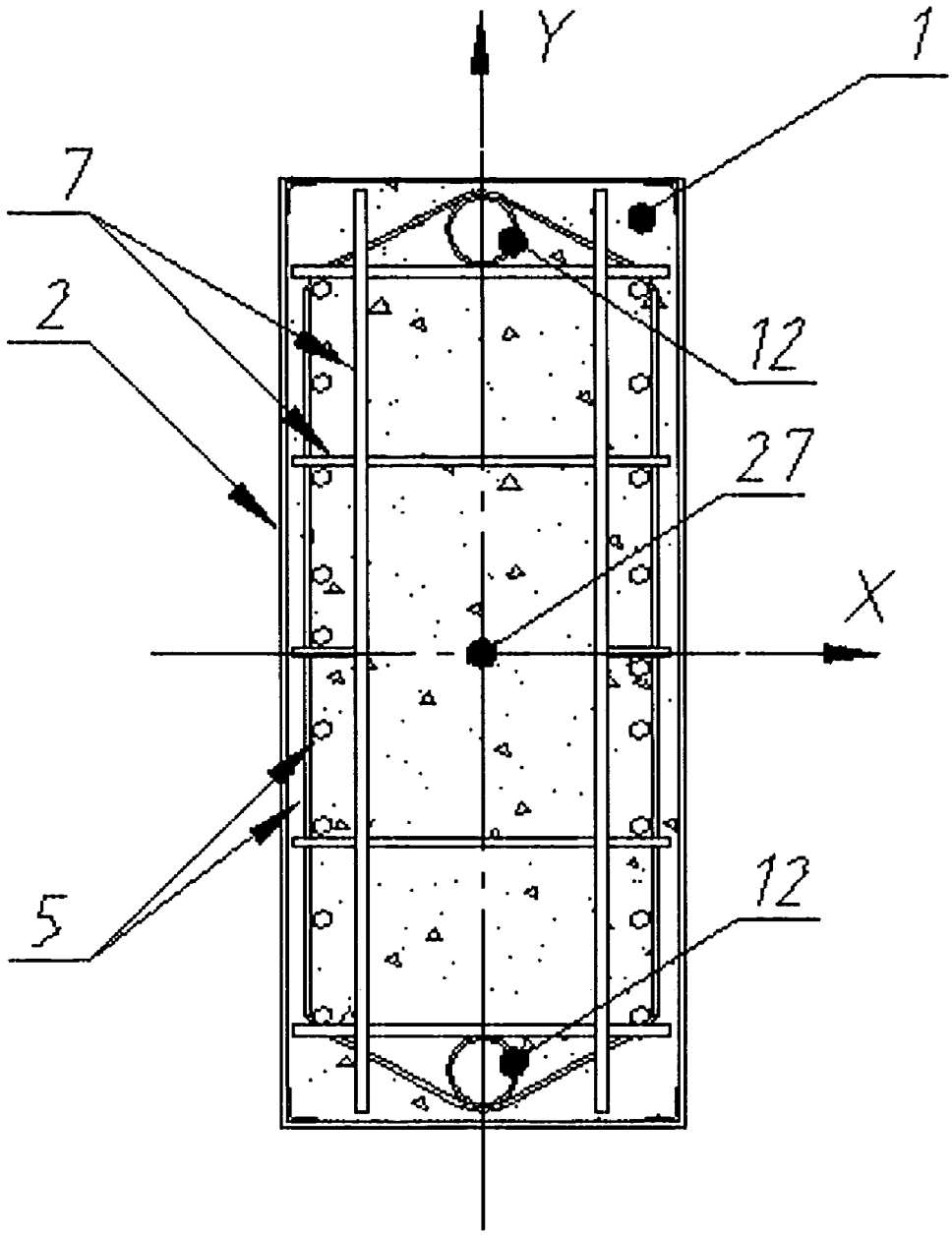
FIG. 5 shows section "3-3" in FIG. 4 at the level of marks of inserts with perpendicular ribs.
Figure 6:
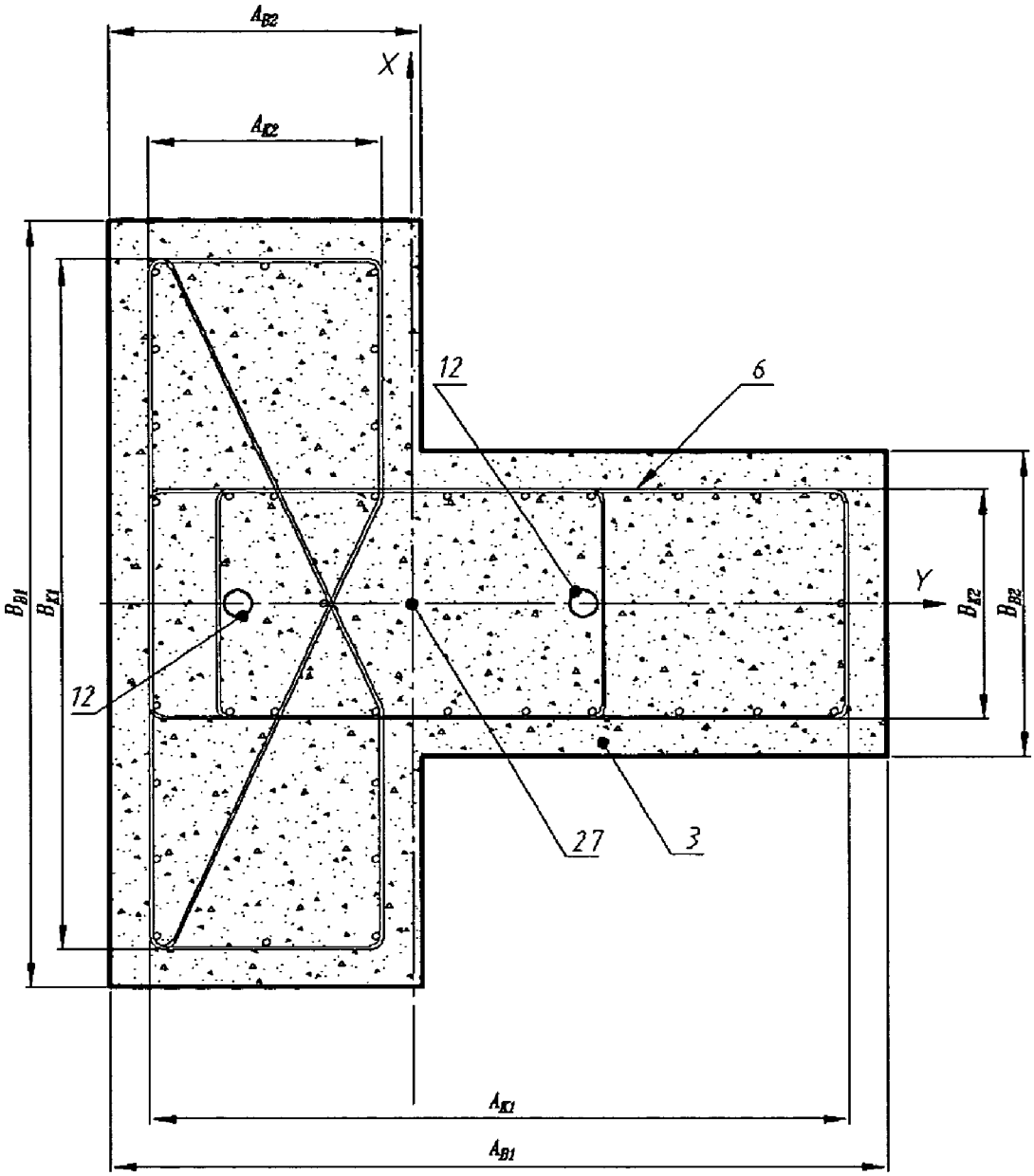
FIG. 6 shows section "4-4" in FIG. 4 in the lower foundation part of the column.
Figure 7:
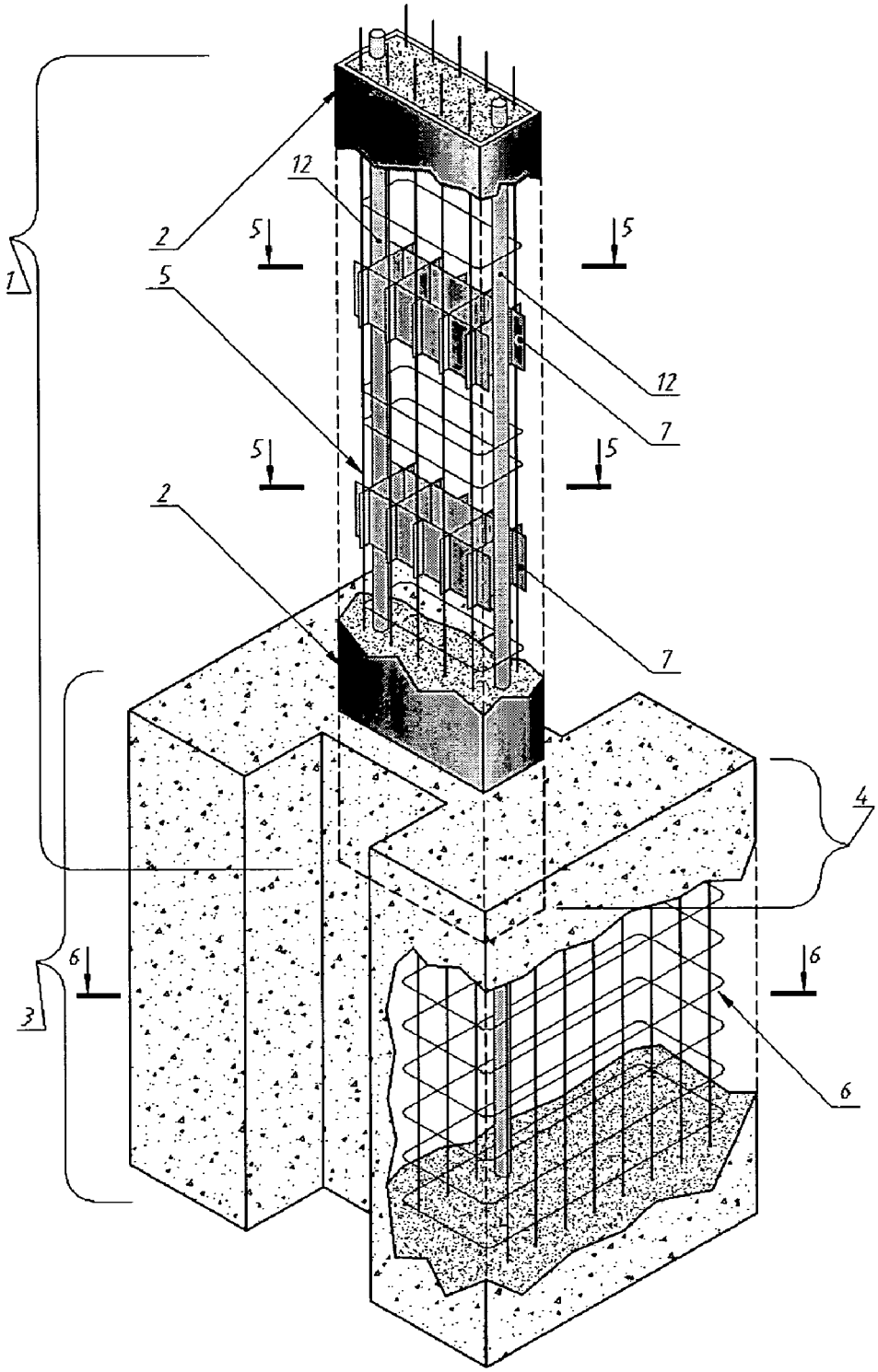
FIG. 7 shows the example of the design of the reinforced-concrete column with arrangement of non-removable casing with the closed-type contour of rectangular cross-section in the upper bearing part of the column for the case of constructing the column in three-slit pit of H-section.
Figure 8:
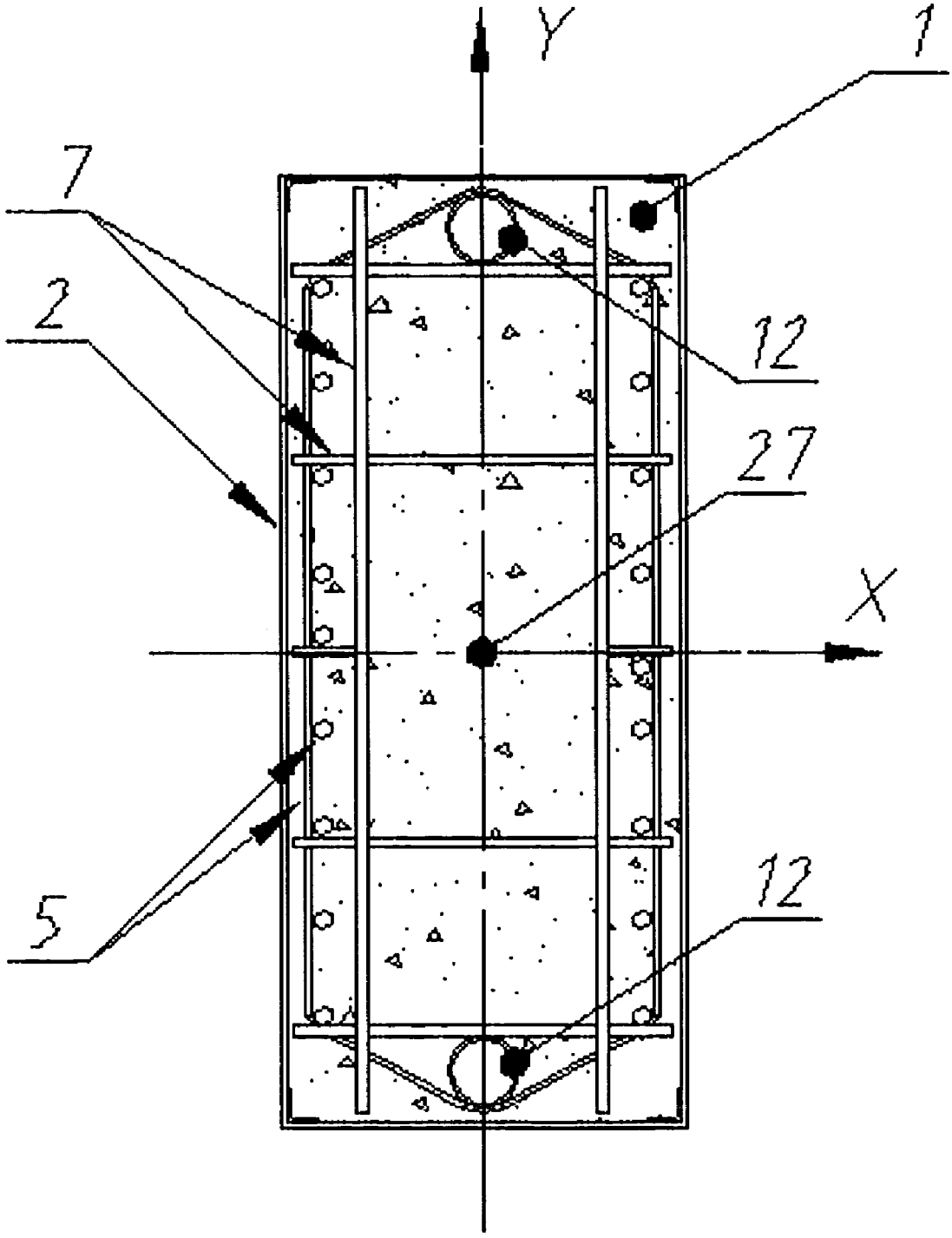
FIG. 8 shows section "5-5" in FIG. 7 at the level of marks of inserts with perpendicular ribs.
Figure 9:
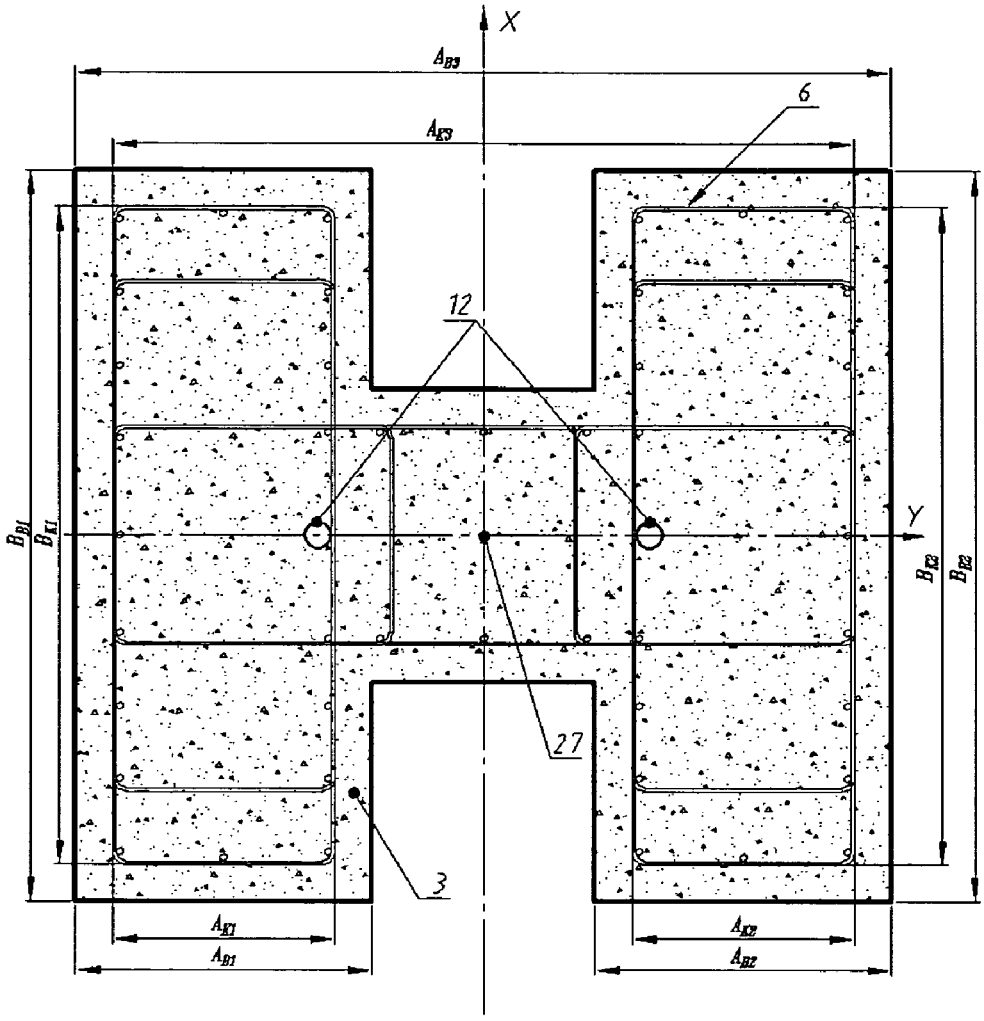
FIG. 9 shows section "6-6" in FIG. 7 in the lower foundation part of the column.
Figure 10:
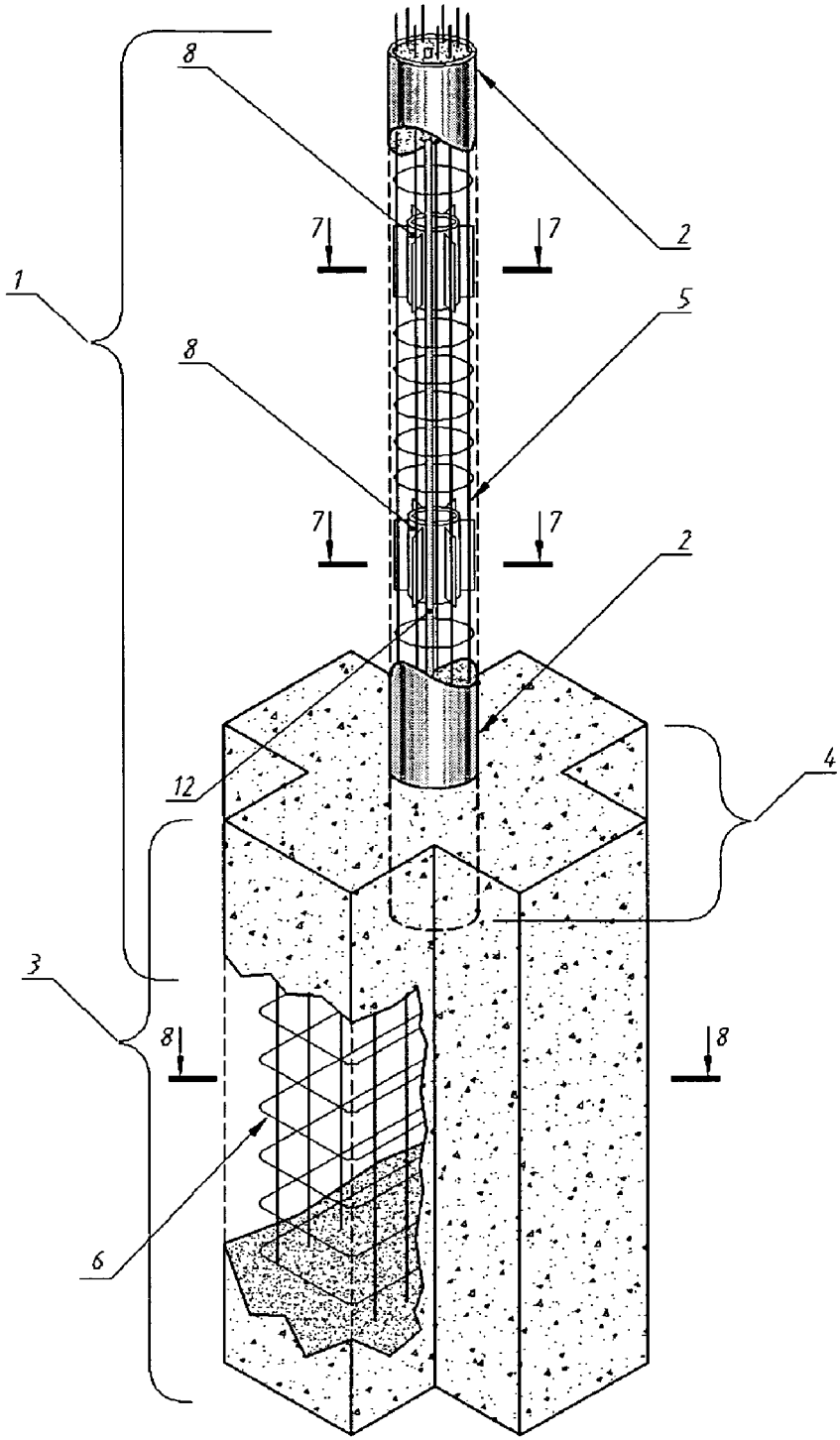
FIG. 10 shows the example of the design of the reinforced-concrete column with arrangement of non-removable casing with the closed-type contour of round cross-section in the upper bearing part of the column for the case of constructing the column in the double-slit pit of cross-shaped section.
Figure 11:
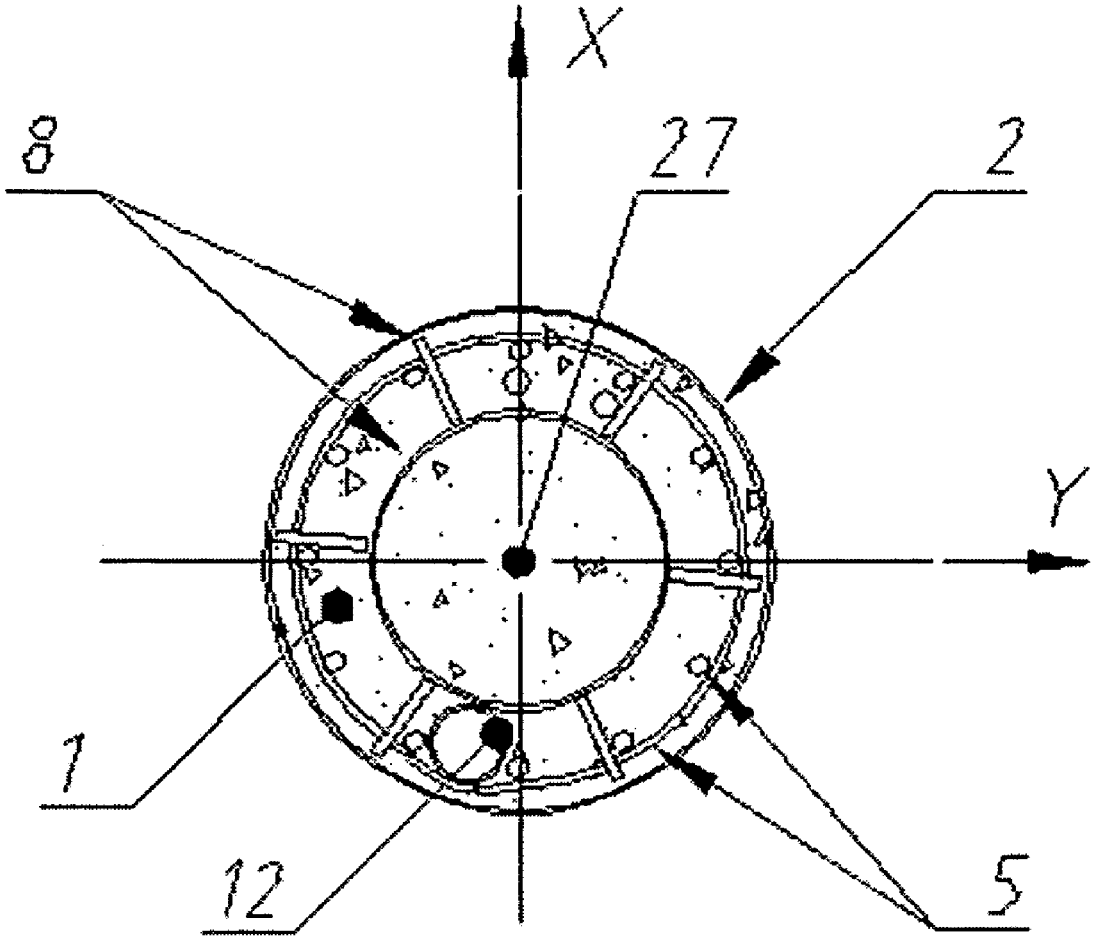
FIG. 11 shows section "7-7" in FIG. 10 at the level of marks of inserts with radial ribs.
Figure 12:
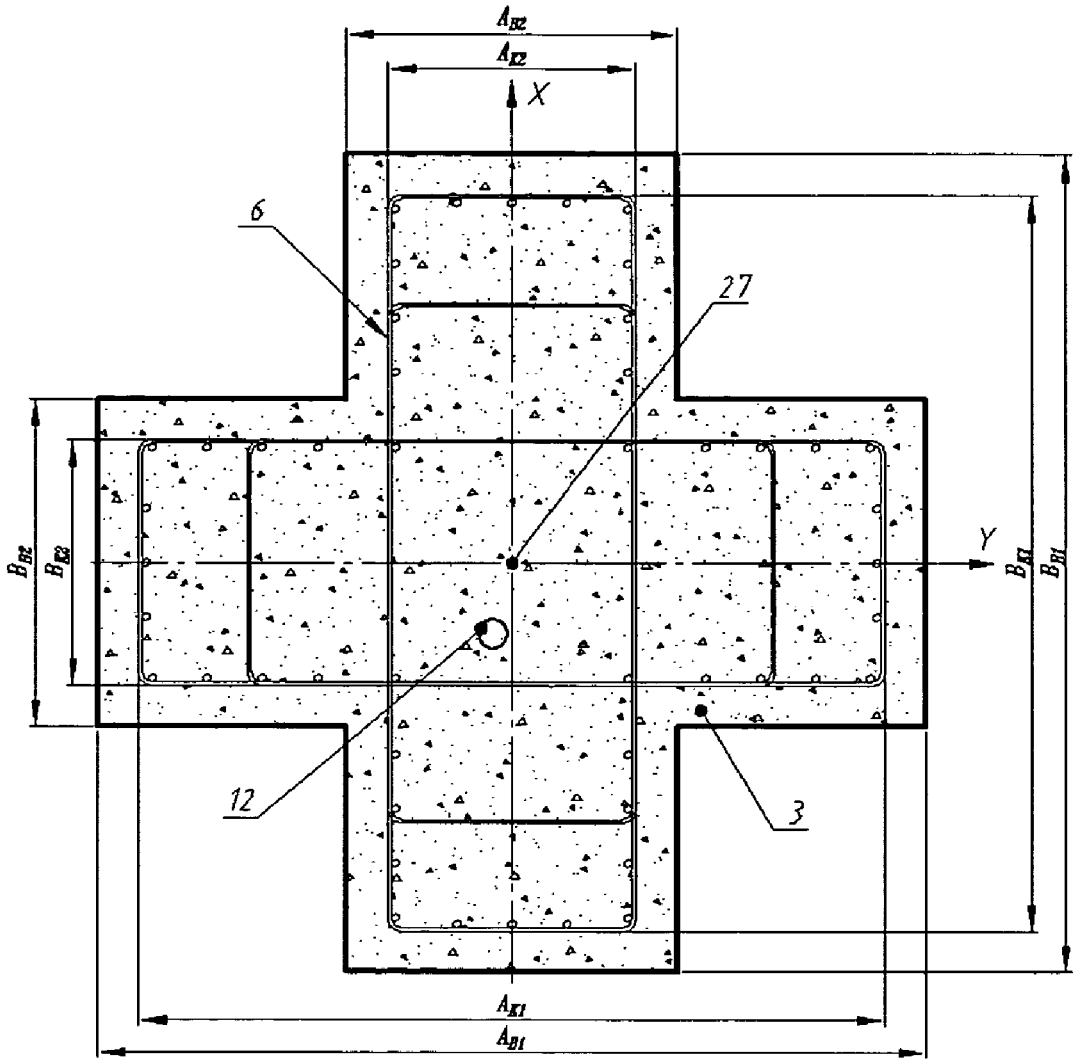
FIG. 12 shows section "8-8" in FIG. 10 in the lower foundation part of the column.
Figure 13:
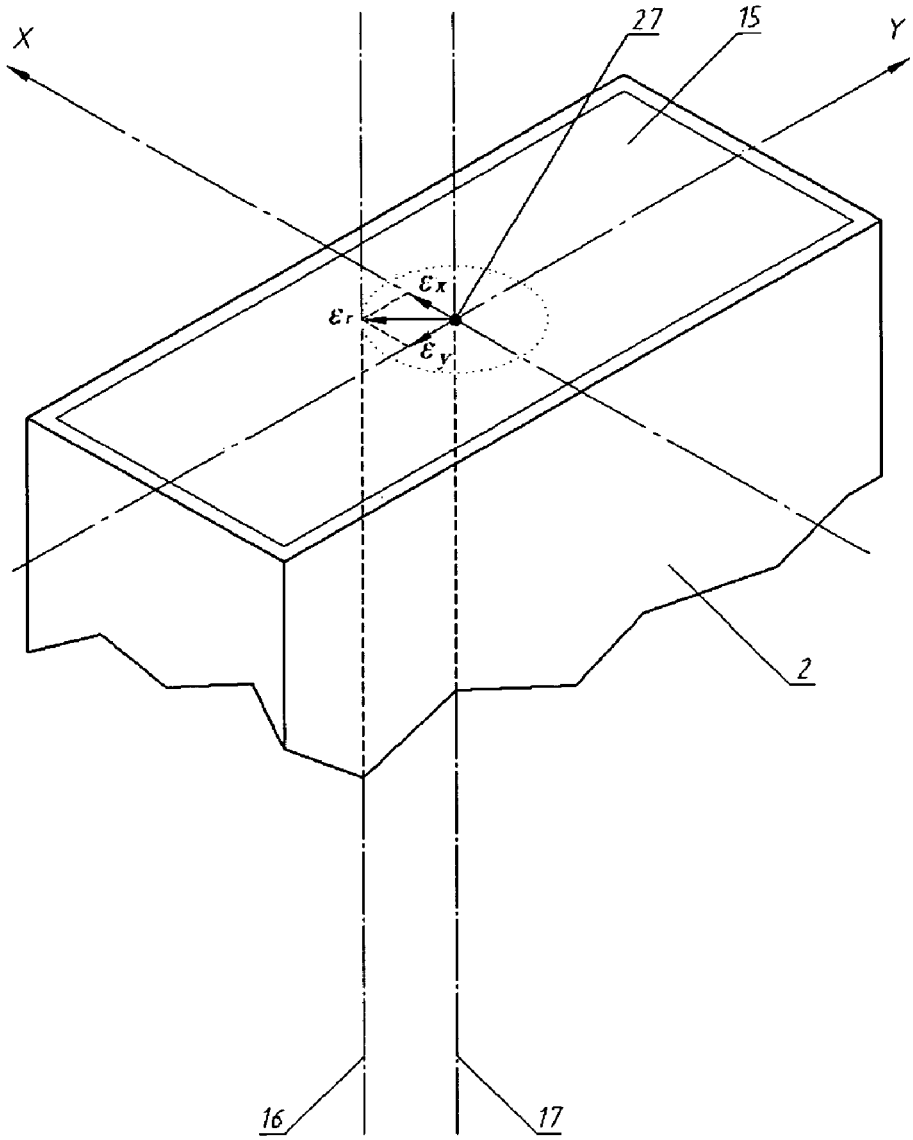
FIG. 13 shows schematic representation of eccentricity of projection of geometric center of the one-piece reinforcing cage of the column relative to projection of its center of masses in the plane of the top of the reinforcing cage of the column for the case of constructing the column in the three-slit pit.
Figure 14:
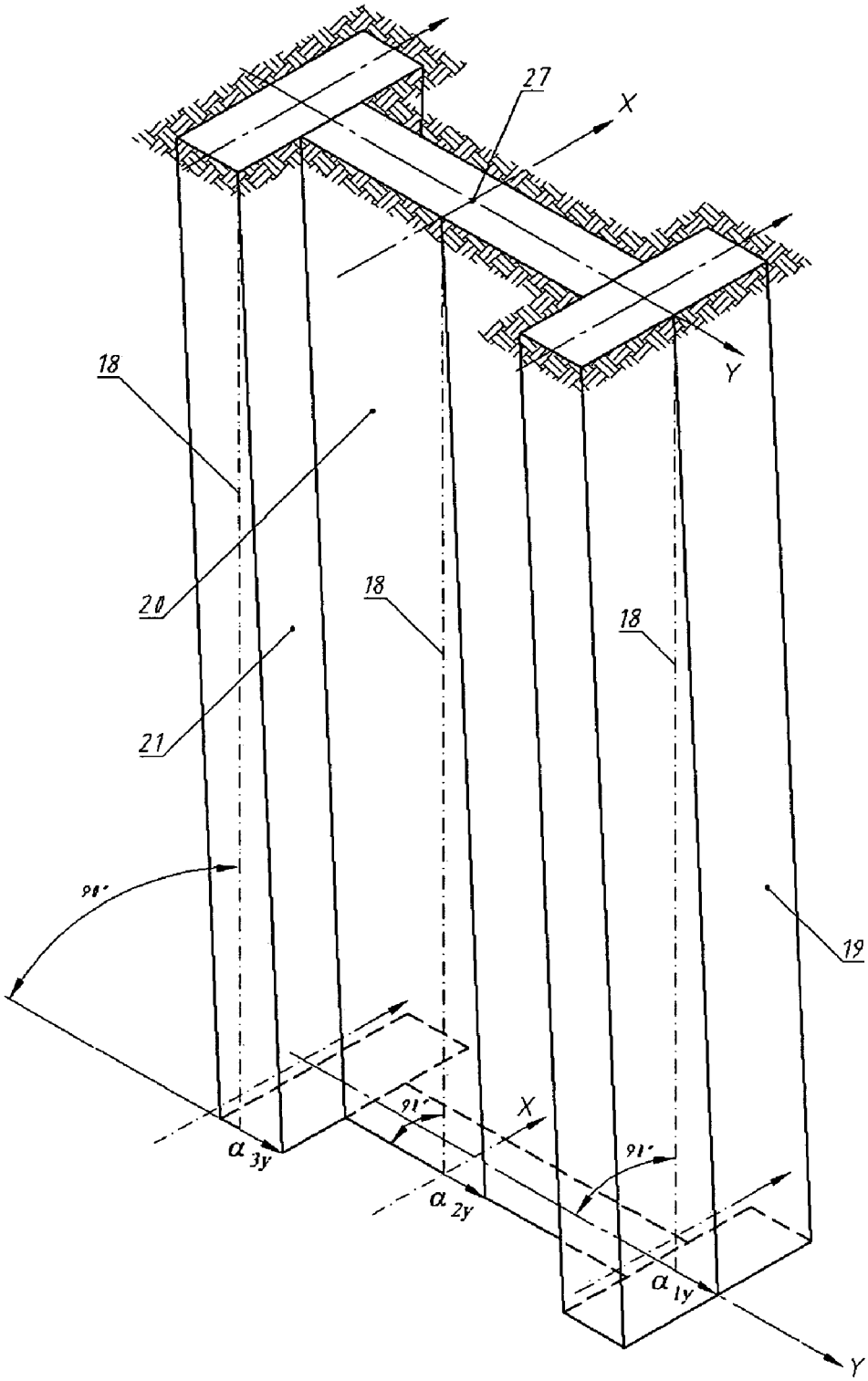
FIG. 14 shows schematic representation of the maximum deviation of planes of the pit slits from vertical along axis Y for the case of constructing the column in the three-slit pit.
Figure 15:
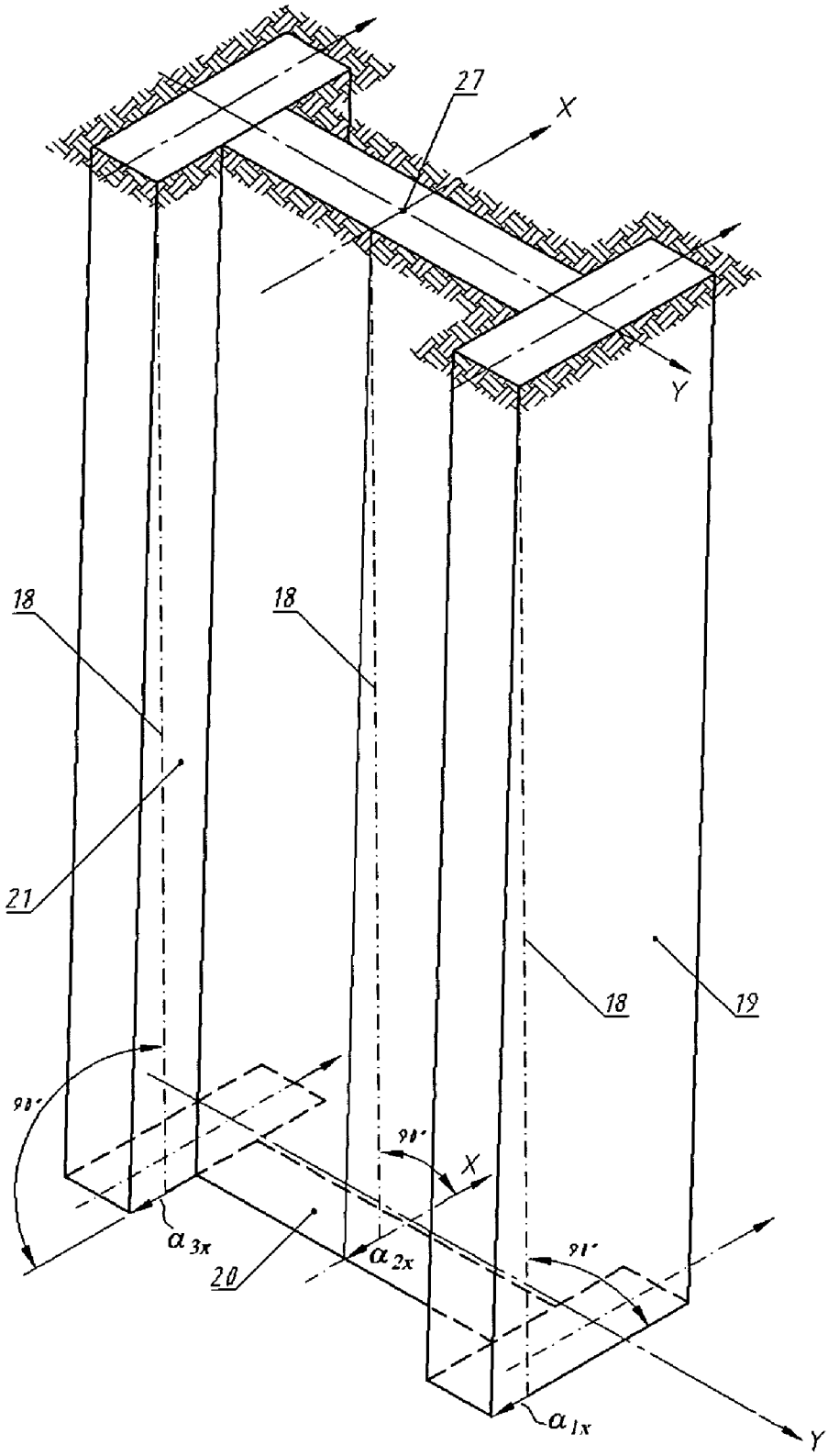
FIG. 15 shows schematic representation of the maximum deviation of planes of the pit slits from vertical along axis X for the case of constructing the column in three-slit pit.
Figure 16:
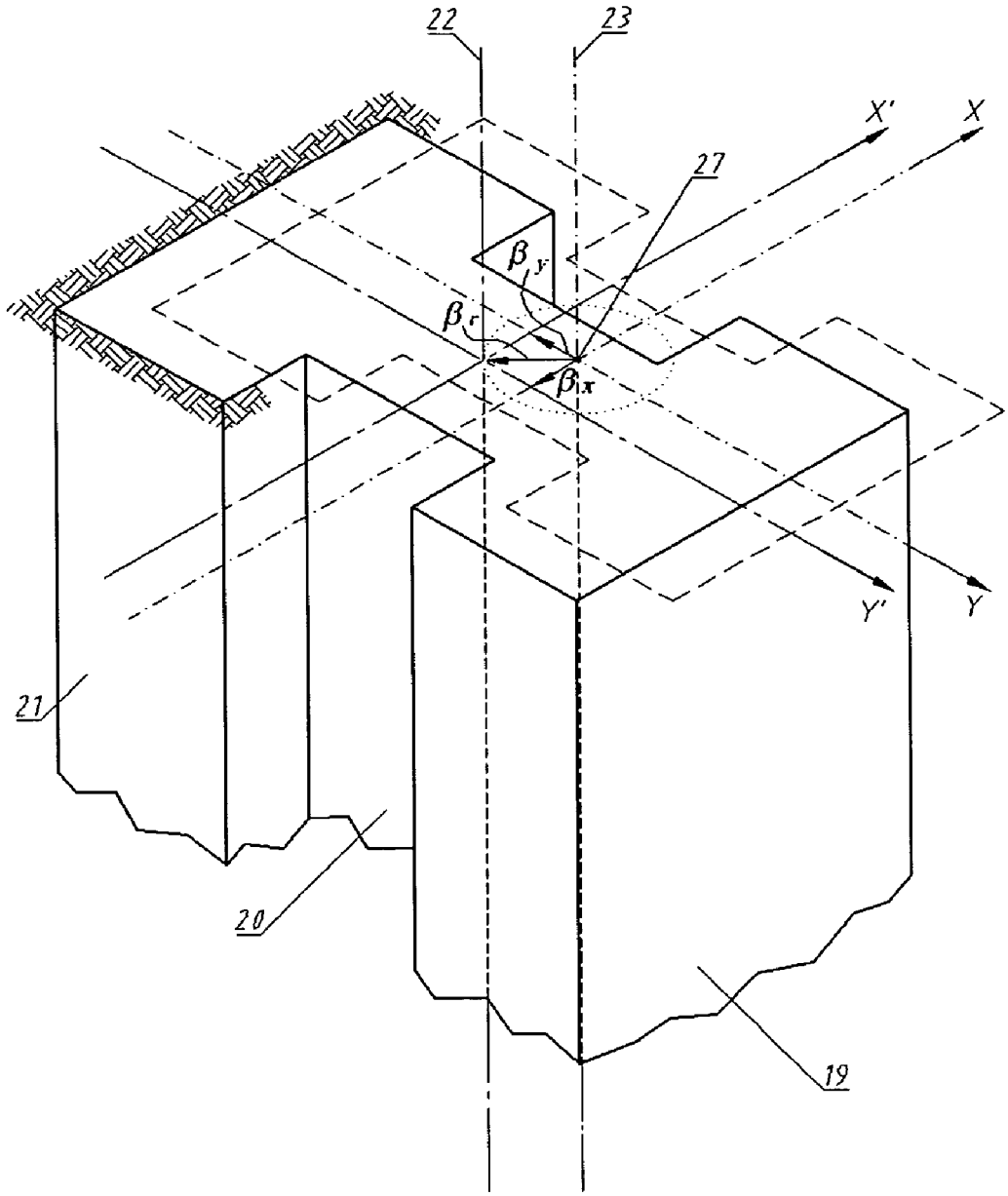
FIG. 16 shows schematic representation of deviation of geometric center of cross-section of the pit in the plane of the top of reinforcing cage for the case of constructing the column in three-slit pit.
Figure 17:
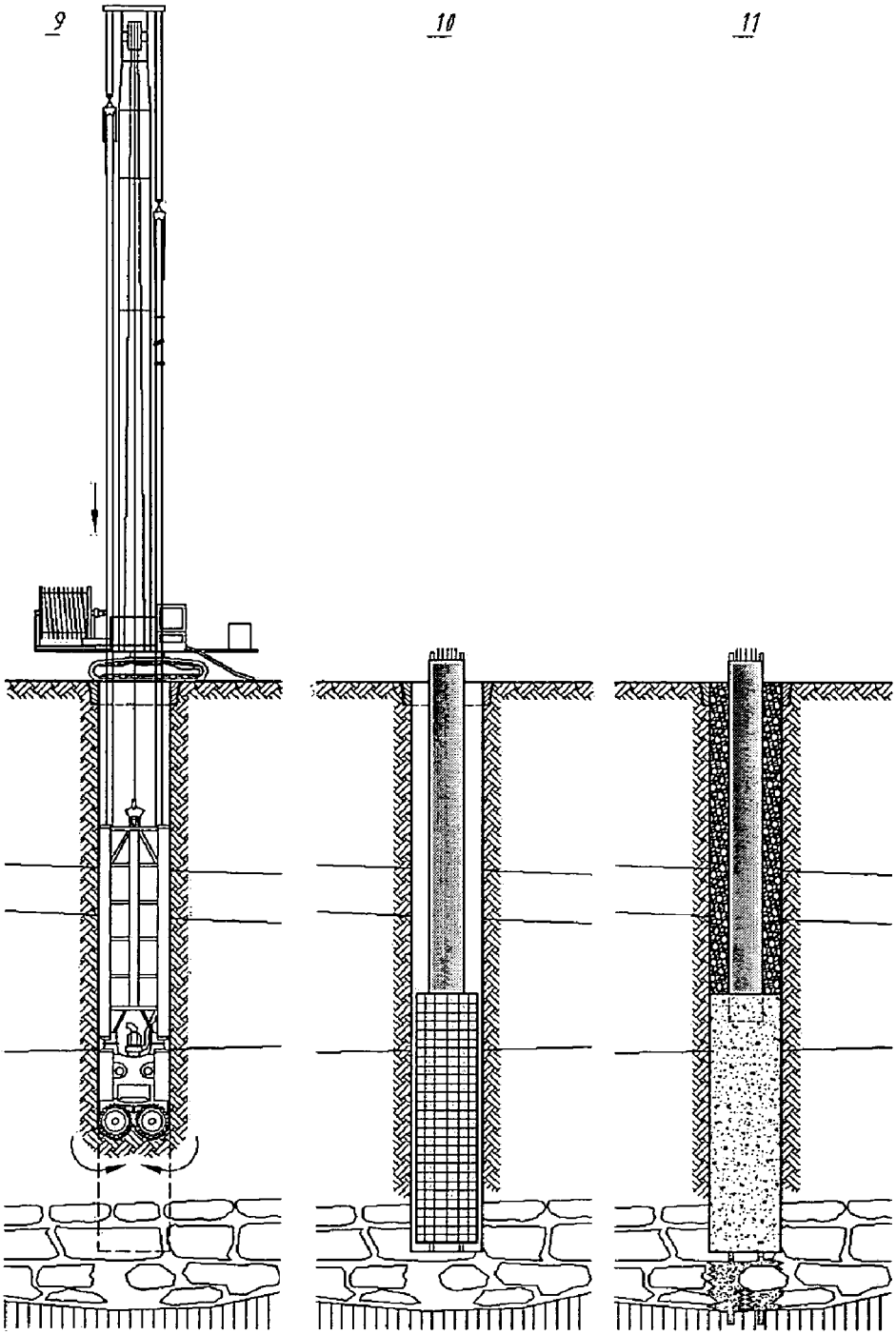
FIG. 17 shows technological sequence of constructing reinforced-concrete column in the single-slit pit.
Figure 18:
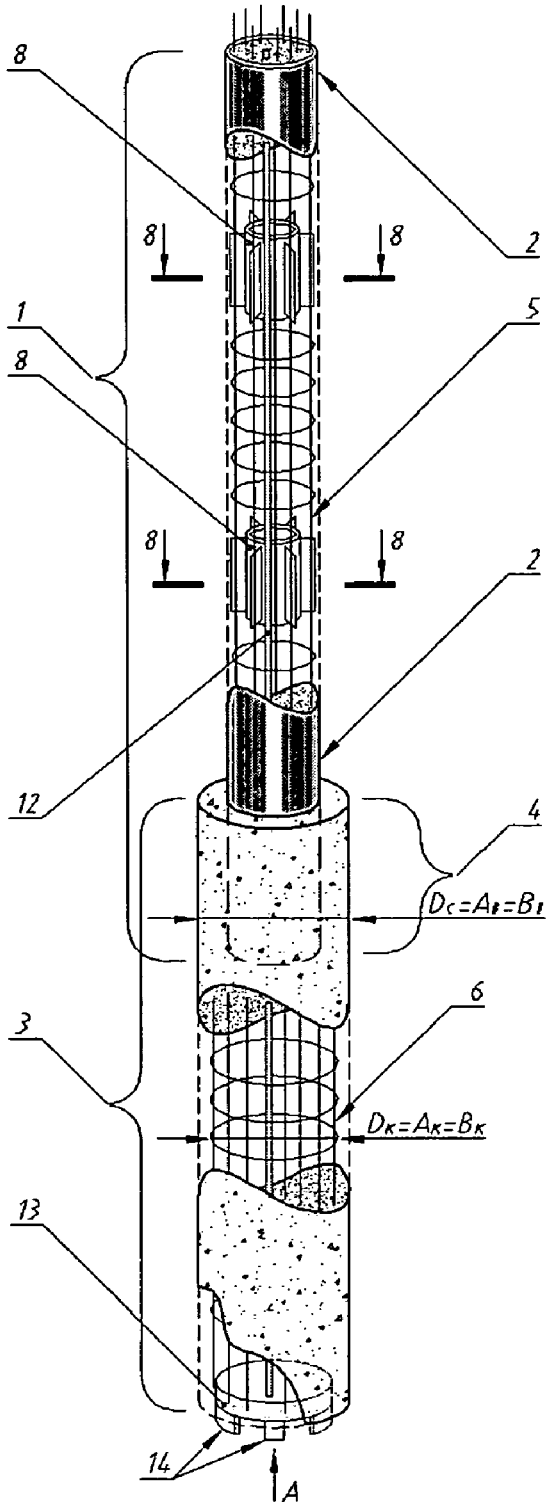
FIG. 18 shows the example of the design of the reinforced-concrete column with arrangement of non-removable casing in the upper bearing part of the column for the case of constructing the column in the borehole.
Figure 19:
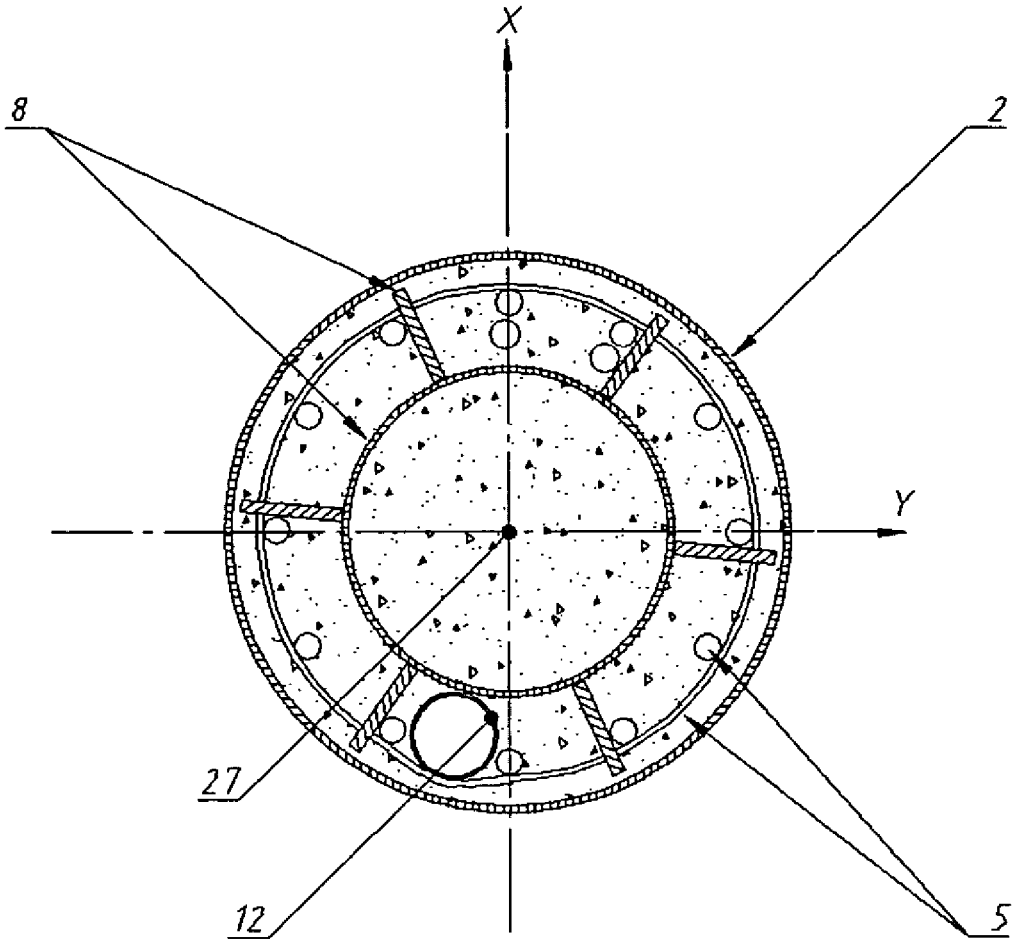
FIG. 19 shows section "8-8" in FIG. 18 at the level of the marks of inserts with radial ribs.
Figure 20:
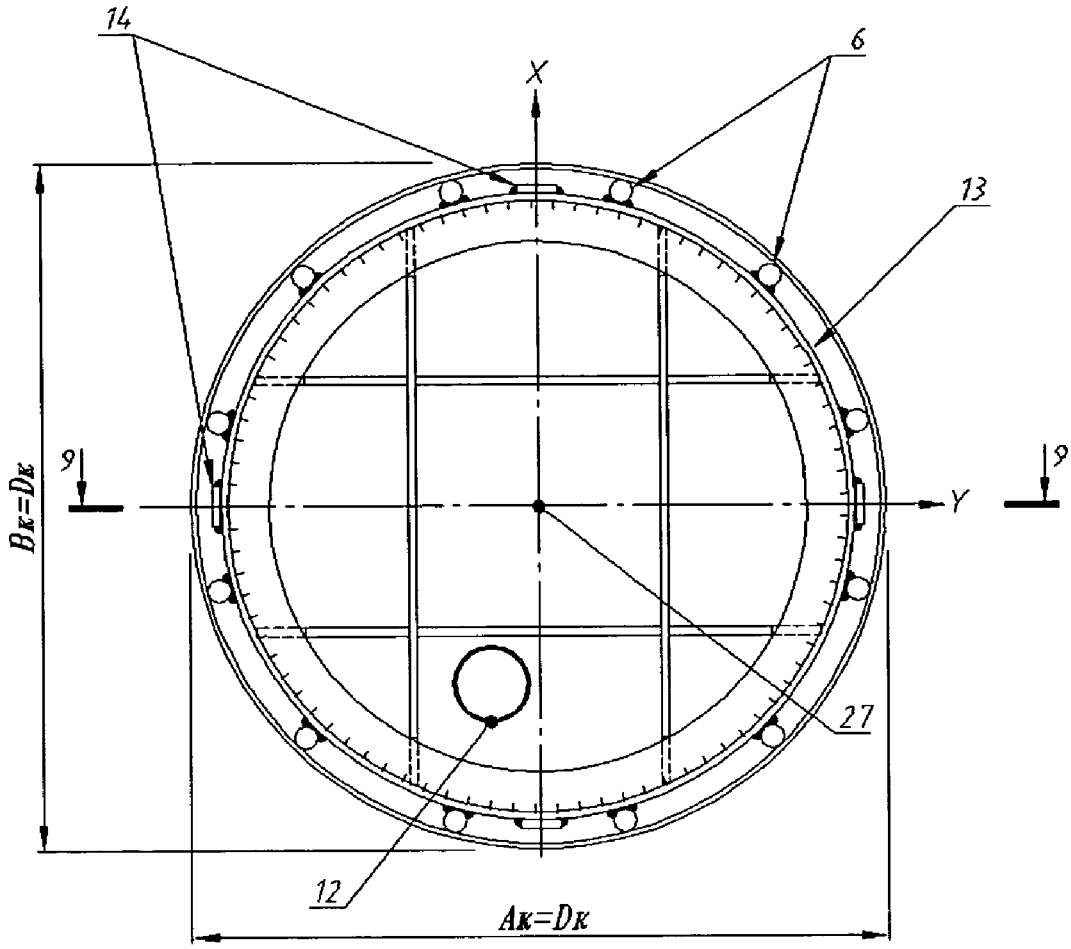
FIG. 20 shows the view along arrow "A" in FIG. 18.
Figure 21:
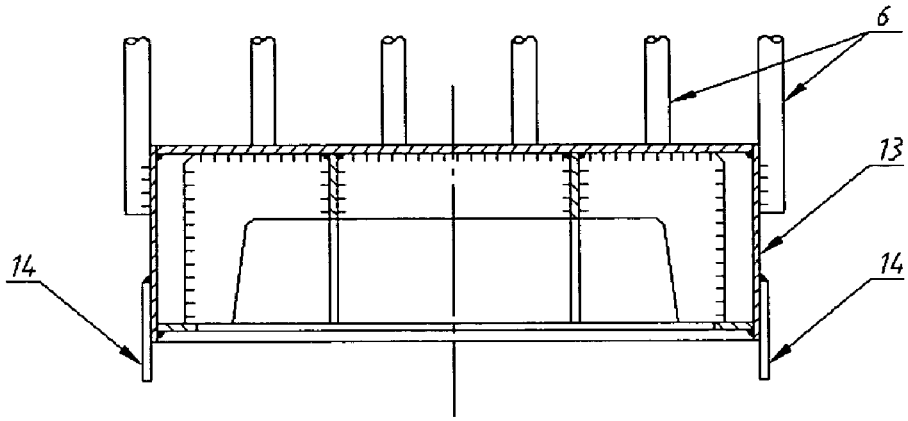
FIG. 21 shows section "9-9" in FIG. 20.
Figure 22:
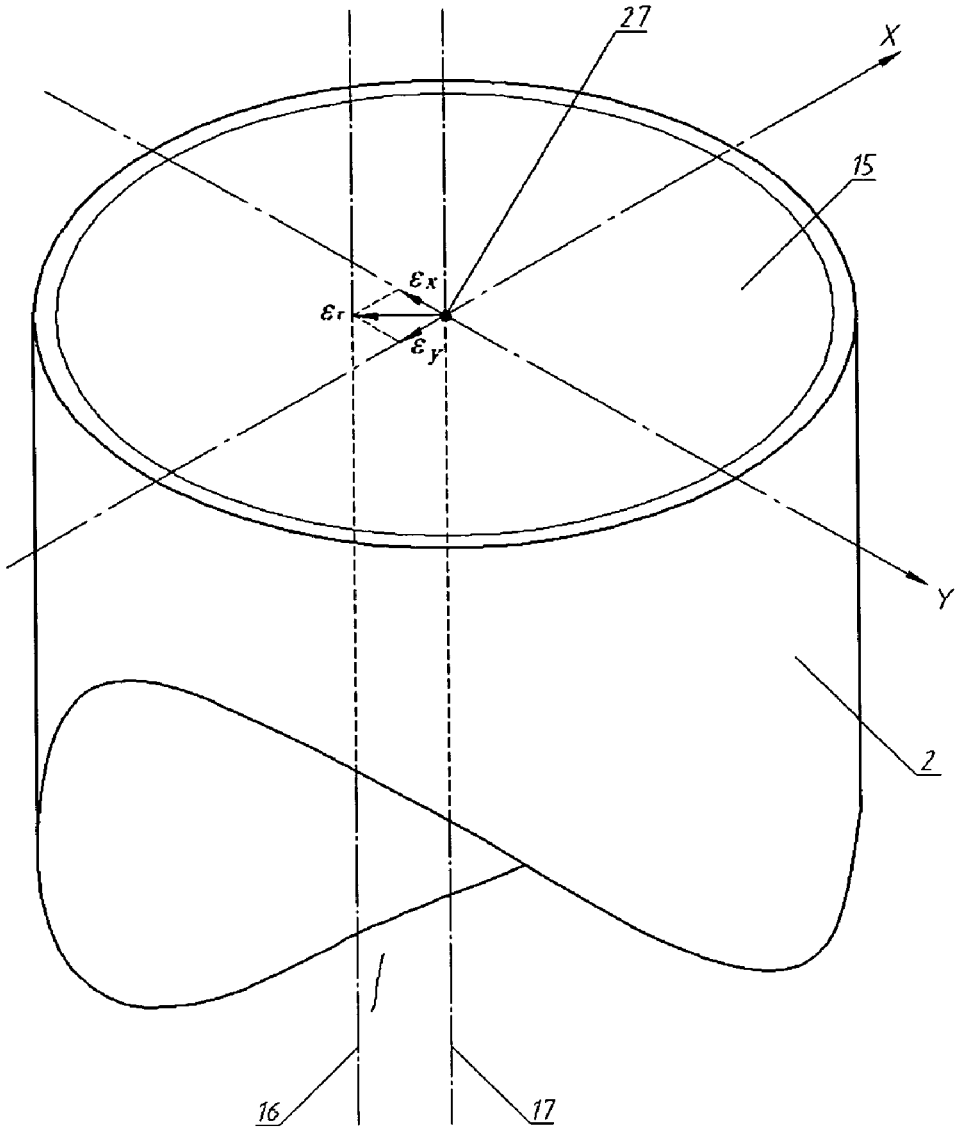
FIG. 22 shows schematic representation of eccentricity of projection of combined geometric center of one-piece reinforcing cage of the column with respect to projection of its center of masses in the plane of the top of reinforcing cage of the column for the case of constructing the column in the borehole.
Figure 23:
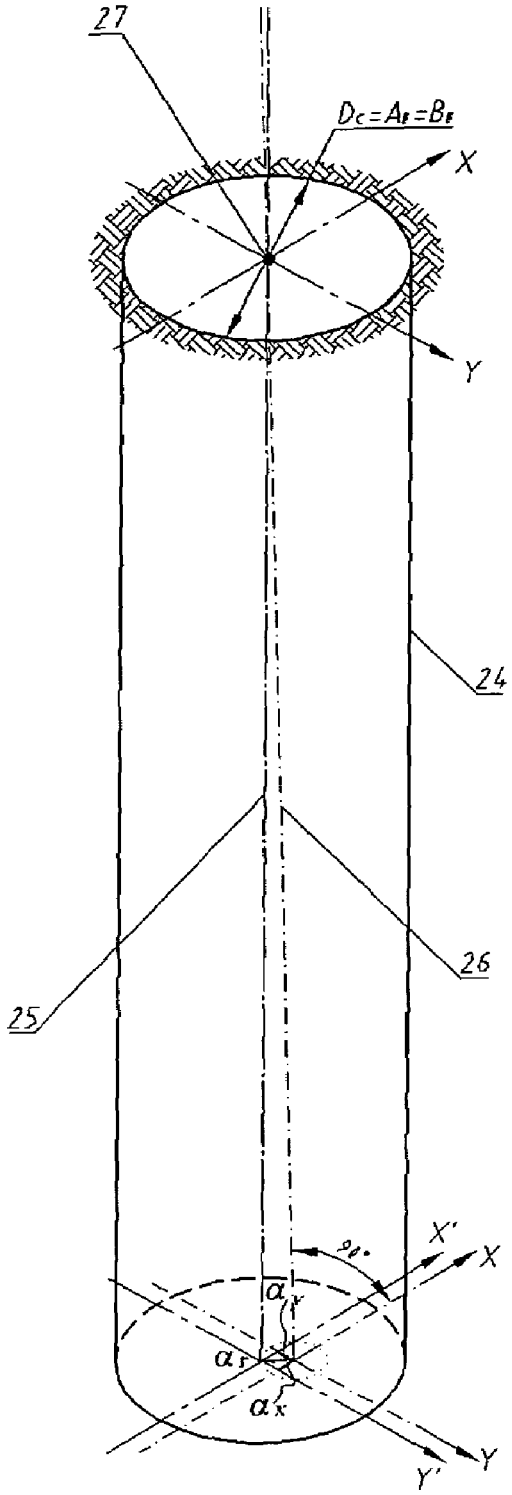
FIG. 23 shows schematic representation of the maximum deviation of the axis of the borehole from vertical for the case of constructing the column in the borehole.
Figure 24:
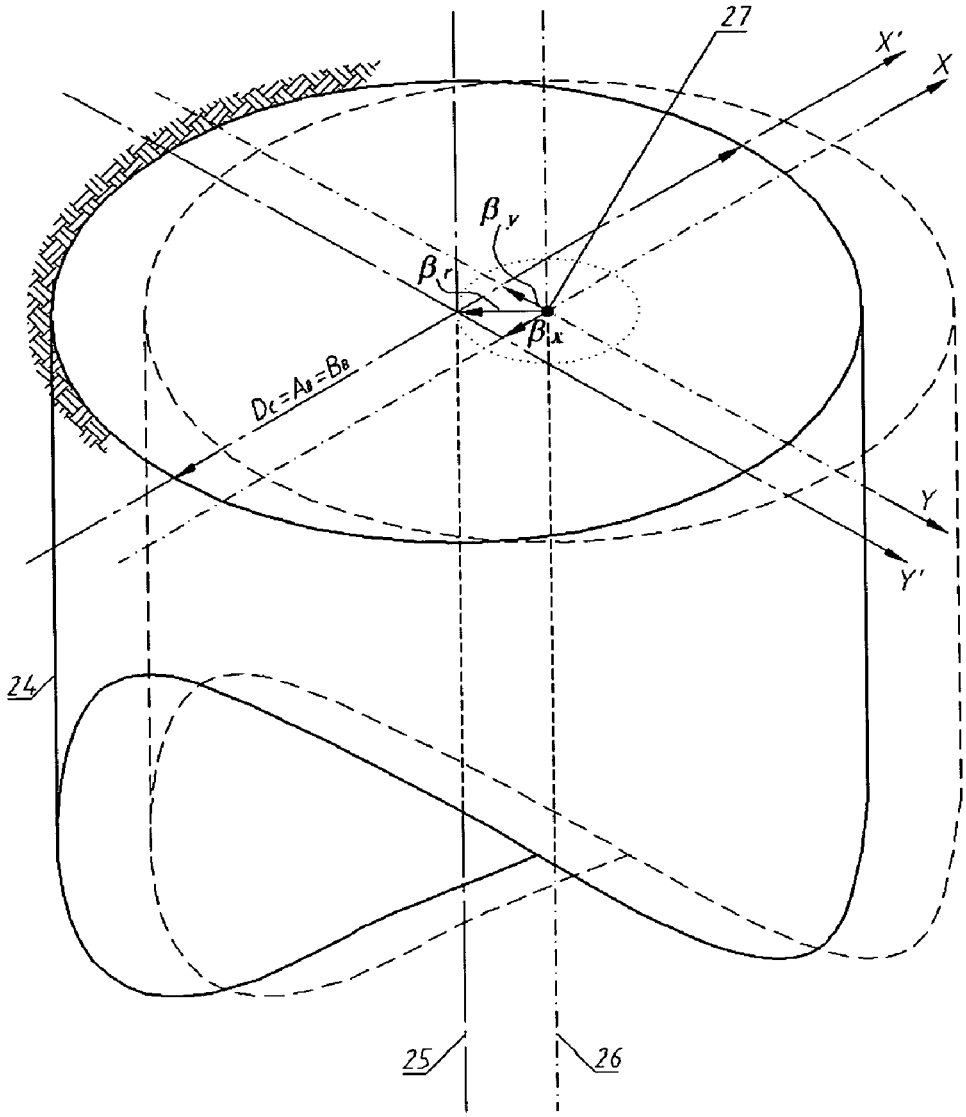
FIG. 24 shows schematic representation of deviation of geometric center of cross-section of the borehole in the plane of the top of the column for the case of constructing the column in the borehole.
Figure 25:
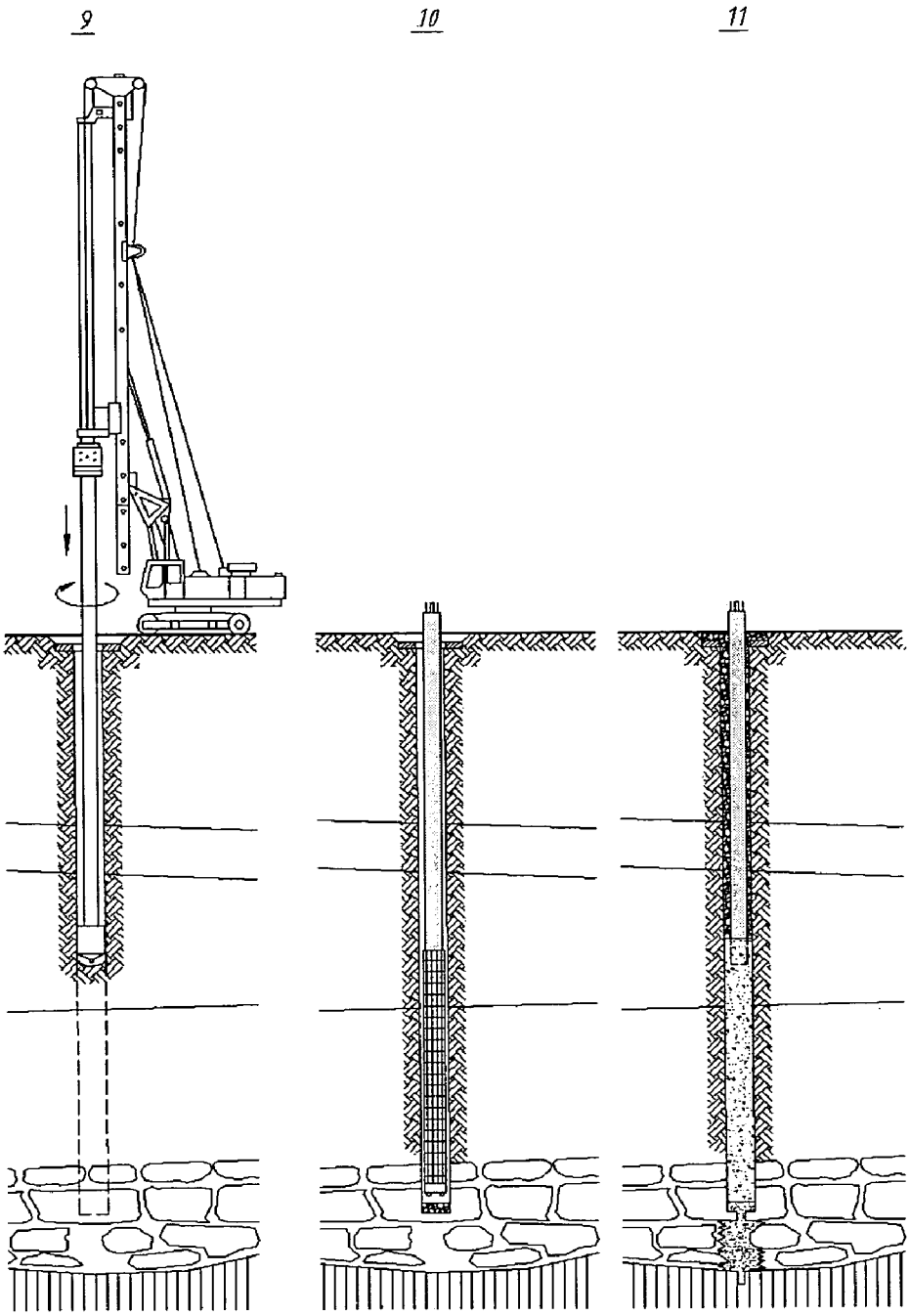
FIG. 25 shows technological sequence of constructing the reinforced-concrete column in the borehole.

In the FIGS. 1-25 are designated:

1—top bearing part of column; 2—non-removable casing with closed-type contour; 3—lower foundation part of column; 4—attachment (fixity); 5—reinforcing cage (upper part); 6—reinforcing cage (lower part); 7—insert with perpendicular ribs; 8—insert with radial ribs; 9—soil pit arrangement; 10—loading and centering of reinforcing cade; 11—column making monolithic; 12—process pipeline for widening and cementation of the soil base; 13—bottom hole chamber; 14—fixing plates; 15—column top plane; 16—axis of center of masses of column reinforcing cage; 17—geometric axis of column cage; 18—vertical; 19—first slit of three-slit pit; 20—second slit of three-slit pit; 21—third slit of three-slit pit; 22—geometric axis of three-slit pit; 23—project vertical axis of three-slit pit; 24—borehole; 25—geometric axis of borehole; 26—project vertical axis of borehole; 27—geometric center of cross-section.

DETAILED DESCRIPTION OF THE PREFERRED EMBODIMENTS

The reinforced-concrete column (FIGS. 1, 4, 7, 10) is made with possibility of its installation in the soil pit; it contains one-piece reinforcing cage (5, 6) made monolithic with concrete mix and inserts (7 or 8) of the column having closed-type contour with stiffening ribs. The column is divided into the upper part (1) (bearing part for floors) and the lower part (3) (foundation bearing part) with basic sizes Aki and Bki of the branches of the lower part of reinforcing cage along axes Y and X, respectively; the reinforcing cage in the upper bearing part is arranged into non-removable casing (2) with the closed-type contour. The upper and lower parts of reinforcing cage are connected "lap joint" beforehand, or at the level of the guide pit during installation in attachment (4) to ensure fixing of the upper part of the column in the lower foundation part after making the column monolithic.

The column is made with basic overall sizes of branches of the lower part of reinforcing cage along axis Y–Aki<Abi by value $\Omega_y=2(\epsilon_y+\alpha_y+\beta_y)$ and along axis X–Bki<Bbi by value $\Omega_x=2(\epsilon_x+\alpha_x+\beta_x)$ for compensation for eccentricity of installation of one-piece reinforcing cage of the column and compensation for defects of excavation of the pit slits in the soil during construction of the column which ensures raised accuracy of the column installation in the project position.

The upper part of the column reinforcing cage (5) is assembled from working longitudinal and distribution rods and practically nothing differs from the reinforcing cage of the traditional column.

Inserts (7 or 8) in the form of rectangular or round pipes with stiffening ribs welded perpendicularly or radially, or in the form of pipes of other arbitrary shape with stiffening ribs are installed in the reinforcing cage of the upper part (5) to ensure coupling of the column constructed in single- or multi-slit pits, with the floor slabs of underground stories and with the foundation slab.

The overall sizes of embedded pipes are less than overall sizes of non-removable casing with the closed-type contour (2) by a double width of the bearing contour fitted in bracket enabling to accomplish support of floorlabs and found slab onto the slit column by "concrete-on-concrete" principle with no allowance made for operation of the non-removable casing (2) which provides fire-resistance of load-bearing structures necessary for underground structures. The length of inserts (7 or 8) is taken equal to no less than the sum of the thickness of the floor (found slab) adjacent in the bond joints with the reinforced-concrete column and tripled value of mounting tolerance by the height of the column cage (3×50 mm).

The stiffening ribs welded to the embedded pipe perpendicularly or radially compensate for weakening of load-carrying capacity of the column during cutting out of concrete when accomplishing bearing fitted in brackets of the bond joints with the floors and found slab. The stiffening ribs are also used for uniaxial coupling of longitudinal working rods of the upper part of the column reinforcing cage (5) between each other with application of electric welding method.

The upper part of the column reinforcing cage (5) at the level of the bottom of attachment (4) in the lower part of the column reinforcing cage (6) is rigidly secured in the non-removable casing with the closed-type contour (2) by welding to the inner locking device.

The lower part of the column reinforcing cage (6) is assembled from working longitudinal and distribution rods and rigidly connected by lap joints with non-removable casing with the closed-type contour (2) in the zone of attachment (4) prior to installation of one-piece reinforcing cage into the pit.

A through process pipeline (12), the top of which is brought out above the head of the erected column, and the bottom—to the lower plane of the lower part of reinforcing cage (6) and which is stopped temporarily by a wooden or gypsum plug, is laid inside the upper and lower parts (5, 6) of the column reinforcing cage. The process pipeline (12) serves for checking vertical position of one-piece reinforcing cage during installation with application of inclinometer; for individual, defining more precisely geological exploration, with carried out after the column is made monolithic; after washing of the base of the reinforced-concrete column from mud, as well as after formation of widened bottom and cementation of the soil base.

In particular case, the reinforced-concrete column (FIG. 18) is made in the borehole, it comprises reinforcing cage (5, 6) made monolithic with concrete mix and inserts (8) having closed-type contour with radial stiffening ribs. The column is divided into the upper part (1) (bearing part for floors) and the lower part (3) (foundation bearing part) with equivalent diameter $D_C=A_B=B_B$; the reinforcing cage is placed into non-removable casing (2); in this case, in particular, non-removable casing is placed only in the upper bearing part of the column. In this case, the upper and lower parts of reinforcing cage are coupled "lap joint" with the attachment (4) to ensure rigid bond and unity of the cage of the upper and lower parts. The lower part in the base is made with the bottom hole chamber (13) to ensure load-carrying capacity of the column over the base with the use of fixing plates (14) to fix the column bottom from horizontal displacements.

The column in the borehole is made with maximum outer diameter $D_k=A_K=B_K<D_c=A_B=B_B$ by value $\Omega_r=2(\epsilon_r+\alpha_r+\beta_r)$ for compensation for the column eccentricity and for compensation for the defects of the borehole drilling during column construction which ensures raised accuracy of the column installation in the project position.

The upper part of the column reinforcing cage (5) constructed in the borehole is assembled from working longitudinal and distribution ring-shaped or spiral rods and practically differs nothing from the reinforcing cage of the traditional bored pile.

Inserts (8) in the form of the pipes of a lesser diameter with radially welded stiffening ribs are installed in the reinforcing cage of the upper part (5) to ensure the bond of the reinforced-concrete column constructed in the borehole with the floor slabs of underground stories and bedplare. The diameter of inserted (embedded) pipes is less than the diameter of non-removable casing-pipe (2) by double width of bearing ring-shaped fitted in bracket enabling to accomplish the support of the floors and found slab onto the reinforced-concrete column by "concrete-on-concrete" principle with no allowance made for operation of casing-pipe (2) which provides fire-resistance of load-bearing structures necessary for underground structures. The length of inserts (8) is taken equal to no less than the sum of thickness of the floor (found slab) adjacent in the bond joints with the reinforced-concrete column and triple value of mounting tolerance by the height of the column skeleton (3×100 mm). The stiffening ribs radially welded to the embedded pipe compensate for weakening of the load-carrying capacity of the column during concrete cutting-out when making bearing fitted in brackets of the bond joints with the floors and found slab. The stiffening ribs also serve for coaxial coupling of the longitudinal working rods of the upper part of the column reinforcing cage (5) between each other with application of electric welding method.

The upper part of the column reinforcing cage (5) constructed in the borehole at the level of the bottom of the attachment (4) in the lower part of the column reinforcing cage (6) is rigidly secured in the non-removable casing-pipe (2) by welding to the inner retaining ring. The lower part of the column reinforcing cage (6) is assembled from working longitudinal and distribution ring-shaped or spiral rods and rigidly coupled by lap welds with non-removable casing-pipe (2) in the zone of the attachment (4). The lower part of the column reinforcing cage (6) is provided with the bottom hole chamber (13) with fixing plates (14) to fix the lower part of the column reinforcing cage (6) from horizontal displacements both at the concluding stage of installation of one-piece reinforcing cage in the borehole and in the process of the column making monolithic.

The bottom hole chamber (13) makes it possible to rule out mixing of the concrete mix in the process of the column making monolithic with application of the method of vertically-displacing pipe inside reinforcing cage (5, 6) with drilling mud settled on the bottom of the borehole, it also enables to accomplish widening and cementation to ensure high load-bearing capacity of the column on the soil base. The bottom hole chamber (13) is calculated for the total pressure of the concrete mix pillar, weight of one-piece reinforcing cage (5, 6), as well as weight of filling up of the gap between the borehole walls and the casing-pipe (2) with granular material (gravel, or crushed stone).

A through process pipeline (12), the top of which is brought out above the head of the constructed column and the bottom—into the bottom hole chamber (13), is laid inside the upper and lower parts (5, 6) of the column reinforcing cage constructed in the borehole. The process pipeline (12) is used to check vertical position of one-piece reinforcing cage during installation with application of inclinometer; for individual, defining more precisely geological exploration, which carried out after the column is made monolithic washing of the bottom hole chamber (13) from drilling mud, as well as after formation of widened bottom and cementation of the soil base.

The individual defining more precisely geological exploration carried out via the process pipeline (12) in the base of the reinforced-concrete column constructed in single- or multi-slit pit, or in the borehole makes it possible to assess actual geological structure and load-carrying capacity of the soils directly in its base, if necessary, to take measures on the increase of load-bearing capacity, to rule out the risk of using reinforced-concrete columns during erection of building structures simultaneously upwards and downwards below the zero mark.

Method of Construction of the Reinforced-Concrete Column

The method of construction of the reinforced-concrete column combines the operations of manufacture and installation of the column in the project position, enables to perform centering of its one-piece reinforcing cage with compensation for eccentricity of projection of geometric axis relative to projection of axis of center of mass.

The method of construction of the reinforced-concrete column in single- or multi-slit pit envisages excavation of the pit (9) with basic sizes along axis $Y-A_{Bi}>A_{Ki}$ by value $\Omega_y=2(\epsilon_y+\alpha_y+\beta_y)$ and along axis $X-B_{Bi}>B_{Ki}$ by value $\Omega_x=2(\epsilon_x+\alpha_x+\beta_x)$ taking into account possible deviation of the pit slits in the plane and from vertical, as a rule, under protection of the clay mud.

The design of the bond joints of the reinforced-concrete column constructed in single- or multi-slit pit with the floors of underground stories and found slab determines tolerance ±50 mm by high-level position of the column head after construction.

When clay mud is used in the process of pit excavation, after completion of excavation, the used clay mud is replaced by a freshly prepared one.

Placement (10) of one-piece reinforcing cage (2, 5, 6) or separately, by parts (first 6, then 2, 5 with the welding coupling during installation at the level of front shaft) is accomplished into the pit by a truck crane with the characteristics required for this purpose with hanging-out of the suspension in the plane of the top (at the level of guide pit) and with gap of at least 40 cm between the lower part of the reinforcing cage and the bottom of the pit.

Then an inventorial centering jig provided with the system of horizontal and vertical hydraulic jacks is installed above the head of the upper part of the column reinforcing cage (2, 5). The supporting cage of the centering jig is temporarily rigidly secured to the guide pit.

Centering (11) of the suspended one-piece reinforcing cage (2, 5, 6) is carried out by horizontal hydraulic jacks of the jig in the plane and by vertical ones—by the height; in this case, the one-piece cage occupies vertical position by own gravity (state of "plumb line") freely hanging up in the soil pit with big basic overall sizes, and vertical jacks are used only for elimination of misalignment of the hanging-out. Compensation for eccentricity of projection of geometric axis with respect to projection of the axis of center of masses is obtained by the design of the reinforcing cage (5, 6).

The concluding operation of centering is the checking of the vertical position of the one-piece reinforcing cage (2, 5, 6) or its upper part (2, 5) with the aid of inclinometer placed in the process pipeline (12).

The column monolithic (11) is made continuously applying the tremie method with pipe inside the reinforcing cage (5, 6) with parallel grouting (filling up) of the gap between non-removable casing with the closed-type contour (2) and pit walls in the soil with granular material (crushed stone or gravel, fraction 40-70 mm). Filling up starts after completion of the lower part of reinforcing cage (6) making monolithic and in parallel with the upper part of reinforcing cage (5) making monolithic. The upper part of reinforcing cage (2, 5) is preliminarily rigidly secured to the guide pit and the inventorial centering jig is removed.

After the column is constructed in single- or multi-slit pit via process pipeline the end faces of which are stopped with wooden or gypsum plugs during the period of column making monolithic, individual defining more precisely geological exploration is executed in its base.

Such supplementary geological exploration in addition to the mentioned technical result makes it possible to rule out the risk of impermissible settlement of the column due to discrepancy of actual geological conditions adopted in the project, and take a proper decision under conditions of construction on necessity and the value of widening and cementation of the column soil base to ensure guarantee of load-carrying capacity during erection of buildings and structures simultaneously upwards and downwards below the zero mark.

In particular, the method provides for drilling of the borehole (9, 24) with diameter $D_C=A_B=B_B>D_K=A_K=B_K$ by value $\Omega_r=2(\epsilon_r+\alpha_r+\beta_r)$ taking into account possible deviation of the borehole axis in the plane and from vertical, as a rule, under protection of clay mud.

The design of the bond joints of the reinforced-concrete column constructed in the borehole with the floors of underground stories and found slabdetermines tolerance ±100 mm on the high-level position of the column head after its construction. Respective tolerance is presented also for the depth of the borehole. Since it is difficult to provide the mentioned tolerance in the process of drilling of the borehole, the method of construction envisages leveling additional filling up with granular material (crushed stone or gravel, fraction 40-70 mm) on its bottom in case of excess of the rated depth of the borehole by more than 100 mm and after cleaning of the borehole bottom from settled drilled soil or rock. If in the process of drilling clay mud is used, after completion of the borehole drilling the used clay mud is replaced for a freshly prepared one.

The quantity of granular material required for additional filling up is determined by calculation after measurement of the depth of the drilled borehole. The granular material is rammed with the use of the standard overhang drilling equipment. Then a repeated measurement of the borehole depth is taken and, if necessary,—repeated additional filling up of the granular material on the bottom and its ramming.

The one-piece reinforcing cage (2, 5, 6) is placed into the borehole by a truck crane possessing the characteristics required for this purpose.

The loaded reinforcing cage (2, 5, 6) is supported with the help of bottom hole chamber (13) on the borehole bottom filled up with rammed granular material, and the fixing plates (14) are cut in into it.

The inventorial centering jig provided with the system of horizontal and vertical hydraulic jacks is placed above the head of the upper part of the column reinforced-concrete cage (2, 5). The supporting cage of the centering jig is temporarily fixed on the guide pit.

Centering (10) of one-piece reinforcing cage (2, 5, 6) is preceded by lifting of the cage by hydraulic jacks of the jig by value $P \geqq 0{,}1D_C$ with respect to the top of the leveling additional filling up on the borehole bottom. At the same time the bottom hole chamber (13) "is separated" from the borehole bottom by the same value, and the cage is freely hanging up in the borehole occupying vertical position by gravity (state of "plumb line"). Compensation for eccentricity of projection of geometric axis with respect to projection of the axis of center of masses is obtained by the design of the reinforcing cage (5, 6).

Centering (10) of the reinforcing cage in the plane is carried out by the system of horizontal hydraulic jacks. The concluding operation of centering is the checking of vertical position of the one-piece reinforcing cage (2, 5, 6) with the aid of inclinometer placed in the process pipeline (12).

Afterwards, the column cage checked in the plane and occupying position of the "plumb line" is synchronously sinked on the borehole bottom by means of vertical hydraulic jacks of the jig. Fixing rods (14) of the bottom hole chamber (13) are in this case cut in into filling in with granular material on the borehole bottom thus fixing the lower part of reinforcing cage (6) from displacement in the process of the column making monolithic.

The column monolithic (11) is made continuously applying the tremie method with pipe inside one-piece reinforcing cage (5, 6) with parallel grouting (filling up) with granular material (crushed stone or gravel, fraction 40-70 mm) of the gap between the non-removable casing-pipe (2) and the borehole walls. Filling up after completion of the lower part of reinforcing cage (6) making monolithic and in parallel with the upper part of reinforcing cage (5) making monolithic. The upper part of reinforcing cage (2, 5) is preliminarily rigidly secured to the front shaft and the inventorial centering jig is removed.

After the column is constructed in single- or multiple-slit pit via process pipeline the end faces of which are stopped with wooden or gypsum plugs during the period of column making monolithic, individual defining more precisely geological exploration is executed in its base.

Such supplementary geological exploration in addition to the mentioned technical result makes it possible to rule out the risk of impermissible settlement of the column due to discrepancy of actual geological conditions adopted in the project, and take a proper decision under conditions of construction on necessity and the value of widening and cementation of the column soil base to ensure guarantee of load-carrying capacity during erection of buildings and structures simultaneously upwards and downwards below the zero mark.

The process pipeline (12) brought out below the bottom hole chamber (13) enables to wash drilling cutting settled on the borehole bottom and left in the chamber after making the column monolithic and carry out at least cementation pressure test of the base, if widening or greater volume of cementation works is not required.

The method of construction ensures accuracy of accomplishment of the reinforced-concrete column in the borehole with deviation from its axis from vertical—not more than 1:500 and not more than ±5 mm—in the plane.

INDUSTRIAL APPLICABILITY

Combining of functions of foundation element and vertical load-carrying element of the building or structure in the unified design and the method of the column construction raise accuracy of installation, as well as ensure universality and enable to perform works simultaneously (in parallel), and/or successively (in any sequence) above and below the zero ground mark.

The reinforced-concrete column and the method of its construction do not require special tackle and any special technological techniques on construction of the column.

What is claimed is:

1. A reinforced-concrete column in a soil pit comprising a reinforcing cage making monolithic with concrete mix and inserts, said reinforcing cage having an upper bearing and a lower foundation parts, wherein the column is made in a non-removable casing in a single- or multi-silt pit in soil, the upper part of the reinforcing cage is arranged in the non-removable casing with a closed-type contour, projection of geometrical center of a cross-section of which is combined with projection of geometric center of a cross-section of the lower foundation part of the reinforcing cage, sizes of branches of the lower part of the reinforcing cage along axis Y are taken with a proviso that:

$A_{Ki}<A_{Bi}$ by value $\Omega_y=2(\epsilon_y+\alpha_y+\beta_y)$, where

Y—axis passing through geometric center of section of the cage lower part;

$A_{Ki}$—basic sizes of the branches of the lower part of the column cage along axis Y;

$A_{Bi}$—basic sizes of pit slits along axis Y corresponding to them;

K—index of a size related to the cage;

B—index of a size related to the pit-slit;

i—size index;

$\epsilon_y$—component of eccentricity along axis Y of projection of geometric center of the reinforcing cage of the column relative to projection of its center of masses in the plane of its top;

$\alpha_y$—maximum deviation of the pit from vertical along axis Y;

$\beta_y$—deviation of geometric center of cross-section of the pit in plane along axis Y in the plane of the column top;

sizes of the branches of the lower part of reinforcing cage along axis X are taken with the proviso that:

$B_{Ki}<B_{Bi}$ by value $\Omega_x=2(\epsilon_x+\alpha_x+\beta_x)$, where

X—axis passing through geometric center of cross-section of the cage lower part perpendicular to axis Y;

$B_{Ki}$—basic sizes of the branches of the column cage lower part along axis X;

$B_{Bi}$—basic sizes of the pit slits along axis X;

$\epsilon_x$—component of eccentricity along axis X of projection of geometric centre of the reinforcing cage of the column relative to projection of its centre of masses in the plane of its top;

$\alpha_x$—maximum deviation of the pit from vertical along axis X;

$\beta_x$—deviation of geometric center of the pit cross-section in the plane along axis X in the plane of the column top, and the inserts are arranged in the column upper bearing part at the levels of marks of the foundation slab and marks of floor slabs and made in form of closed-type contours with stiffening ribs.

2. The device of claim 1, wherein the column is made in the non-removable casing in a borehole with equivalent maximum outer diameter of the reinforcing cage $D_k<D_c$ by value $\Omega_r=2(\epsilon_r+\alpha_r+\beta_r)$, where $D_c=A_B=B_B$—borehole diameter; $\epsilon_r=\sqrt{(\epsilon_x^2+\epsilon_y^2)}$—total eccentricity of projection of geometric axis related to projection of axis of center of masses of the column in the plane of the column top; $\alpha_r=\sqrt{(\alpha_x^2+\alpha_y^2)}$—total deviation of a borehole axis from vertical; $\beta_r=\sqrt{(\beta_x^2+\beta_y^2)}$ total deviation of the borehole axis in the plane;

the non-removable casing is made from a pipe of round, rectangular or other arbitrary cross-section symmetrical relative to axes X, Y with the closed-type contour; and the column lower part is provided with a bottom hole chamber and fixing plates.

3. The device of claim 1, wherein the part of reinforcing cage arranged in the column foundation part is connected by "lap joint" with the part of reinforcing cage arranged in the upper bearing part with attachment of elements of reinforcing cage.

4. The device of claim 1, wherein the sizes of the part of the reinforcing cage arranged in the upper bearing part of column in the slit pits are equal or less than the inner sizes of the non-removable casing with the closed-type contour, basic sizes along axes X, Y of the branches of the lower part of the reinforcing cage arranged in the lower foundation part of the column are equal or more than basic outer sizes of the non-removable casing.

5. The device of claim 2, wherein the equivalent outer diameter of the part of the reinforcing cage arranged in the upper bearing part of column in the borehole pits is equal or less than an inner diameter of the non-removable casing, an equivalent inner diameter of the part of the reinforcing cage arranged in the lower foundation part of the column is equal or greater than an outer diameter of the non-removable casing.

* * * * *